US009982926B2

(12) United States Patent
Lee et al.

(10) Patent No.: US 9,982,926 B2
(45) Date of Patent: May 29, 2018

(54) COOLING SYSTEM AND REFRIGERATOR INCLUDING A COOLING SYSTEM

(71) Applicant: LG ELECTRONICS INC., Seoul (KR)

(72) Inventors: Kyeongweon Lee, Seoul (KR); Seongho Ha, Seoul (KR); Wonhyun Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 201 days.

(21) Appl. No.: 14/645,556

(22) Filed: Mar. 12, 2015

(65) Prior Publication Data

US 2015/0369528 A1 Dec. 24, 2015

(30) Foreign Application Priority Data

Jun. 24, 2014 (KR) ..... 10-2014-0077558

(51) Int. Cl.
*F25B 43/02* (2006.01)
*F25B 43/00* (2006.01)
(Continued)

(52) U.S. Cl.
CPC ..... *F25B 43/003* (2013.01); *F25B 13/00* (2013.01); *F25B 43/02* (2013.01);
(Continued)

(58) Field of Classification Search
CPC ..... F25B 43/003; F25B 13/00; F25B 43/02; F25B 2400/073; F26B 5/16; F26B 7/00;
(Continued)

(56) References Cited

U.S. PATENT DOCUMENTS 3,175,342 A * 3/1965 Balogh ..... F25B 43/003 210/266
4,846,852 A * 7/1989 Schweitzer ..... B01D 53/04 95/125
(Continued)

FOREIGN PATENT DOCUMENTS

CN 1111669 11/1995
CN 1197828 11/1998
(Continued)

OTHER PUBLICATIONS

European Search Report dated Nov. 11, 2015.
Chinese Office Action dated Mar. 27, 2017. (English Translation).

*Primary Examiner* — Frantz Jules
*Assistant Examiner* — Filip Zec
(74) *Attorney, Agent, or Firm* — Ked & Associates LLP

(57) ABSTRACT

A cooling system and a refrigerator including a cooling system are provided. The cooling system may include a linear compressor including a reciprocating piston and a cylinder that accommodates the piston and having an outer circumferential surface, into which a refrigerant may be introduced, a refrigerant filter device provided in the linear compressor to filter the refrigerant introduced into one or more gas inflow of the cylinder, a condenser that condenses the refrigerant compressed in the linear compressor, and a dryer that removes foreign substances or oil from the refrigerant condensed in the condenser. The dryer may include a dryer body including a refrigerant inflow, through which the refrigerant condensed in the condenser may be introduced, and a refrigerant discharge, through which the refrigerant may be discharged, and an adsorption filter accommodated in the dryer body to filter the oil in the refrigerant introduced through the refrigerant inflow.

17 Claims, 20 Drawing Sheets

(51) Int. Cl.
*F25B 13/00* (2006.01)
*F26B 7/00* (2006.01)
*F26B 5/16* (2006.01)

(52) U.S. Cl.
CPC ..... *F25B 2400/073* (2013.01); *F26B 5/16* (2013.01); *F26B 7/00* (2013.01)

(58) Field of Classification Search
CPC .... B01D 15/00; B01D 53/04; B01D 15/0407; B01D 15/0415; B01D 15/26
USPC ..... 62/473; 34/86, 381
See application file for complete search history.

(56) References Cited

U.S. PATENT DOCUMENTS 5,092,911 A * 3/1992 Williams ..... B01D 15/00 55/319
5,158,585 A 10/1992 Saho et al.
5,350,443 A * 9/1994 von Blucher ..... B01D 39/083 55/524
5,517,700 A * 5/1996 Hoffman ..... A61F 9/028 2/428
6,044,649 A 4/2000 Numoto et al.
7,338,552 B2 * 3/2008 Bauer ..... B01D 45/06 422/176
2008/0207868 A1 * 8/2008 Kimura ..... B01J 4/002 528/272
2012/0210745 A1 * 8/2012 Ikeda ..... C09K 5/045 62/474

FOREIGN PATENT DOCUMENTS

CN 101398241 4/2009
CN 102818390 12/2012
CN 103629082 3/2014
DE 10 2005 057 986 6/2007
EP 1 197 711 4/2002
EP 2 339 271 6/2011
EP 2 532 991 12/2012
KR 10-1307688 B1 9/2013
WO WO 2013/071382 5/2013

* cited by examiner

COOLING SYSTEM AND REFRIGERATOR INCLUDING A COOLING SYSTEM

CROSS-REFERENCE TO RELATED APPLICATION(S)

This application claims priority under 35 U.S.C. § 119 to Korean Application No. 10-2014-0077558 filed on Jun. 24, 2014, whose entire disclosure is hereby incorporated by reference.

BACKGROUND

1. Field

A cooling system and a refrigerator including a cooling system are disclosed herein.

2. Background

Cooling systems are systems in which a refrigerant is circulated to generate cool air. In such a cooling system, processes of compressing, condensing, expanding, and evaporating the refrigerant may be repeatedly performed. For this, the cooling system may include a compressor, a condenser, an expansion device, and an evaporator. The cooling system may be installed in a refrigerator or air conditioner, which is a home appliance.

In general, compressors are machines that receive power from a power generation device, such as an electric motor or turbine, to compress air, a refrigerant, or various working gases, thereby increasing in pressure. Compressors are being widely used in home appliances or industrial fields.

Compressors may be largely classified into reciprocating compressors, in which a compression space into and from which a working gas is suctioned and discharged, is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned and discharged, is defined between an orbiting scroll and a fixed scroll to compress the working gas while the orbiting scroll rotates along the fixed scroll. In recent years, a linear compressor, which is directly connected to a drive motor, in which a piston is linearly reciprocated, to improve compression efficiency without mechanical losses due to movement conversion and has a simple structure, is being widely developed.

The linear compressor may suction and compress a working gas, such as a refrigerant, while the piston is linearly reciprocated in a sealed shell by a linear motor, and then discharge the working gas. The linear motor may include a permanent magnet disposed between an inner stator and an outer stator. The permanent magnet may be linearly reciprocated by an electromagnetic force between the permanent magnet and the inner (or outer) stator. As the permanent magnet operates in a state in which the permanent magnet is connected to the piston, the refrigerant may be suctioned and compressed while the piston is linearly reciprocated within the cylinder, and then, may be discharged.

The present Applicant filed a patent (hereinafter, referred to as a "prior document") and then registered the patent with respect to the linear compressor, as Korean Patent No. 10-1307688, filed on Sep. 5, 2013 and entitled "linear compressor", which is hereby incorporated by reference.

The linear compressor according to the prior art document includes a shell that accommodates a plurality of components. A vertical height of the shell may be somewhat high, as illustrated in the prior art document. An oil supply assembly to supply oil between a cylinder and a piston may be disposed within the shell.

When the linear compressor is provided in a refrigerator, the linear compressor may be disposed in a machine chamber provided at a rear side of the refrigerator. In recent years, a major concern of customers is increasing an inner storage space of the refrigerator. To increase the inner storage space of the refrigerator, it may be necessary to reduce a volume of the machine room. To reduce the volume of the machine room, it may be important to reduce a size of the linear compressor.

However, as the linear compressor disclosed in the prior art document has a relatively large volume, the linear compressor is not applicable to a refrigerator, for which increased inner storage space is sought. To reduce the size of the linear compressor, it may be necessary to reduce a size of a main component of the compressor. In this case, a performance of the compressor may deteriorate.

To compensate for the deteriorated performance of the compressor, it may be necessary to increase to a drive frequency of the compressor. However, the more the drive frequency of the compressor is increased, the more a friction force due to oil circulating in the compressor increases, deteriorating performance of the compressor.

BRIEF DESCRIPTION OF THE DRAWINGS

The embodiments will be described in detail with reference to the following drawings in which like reference numerals refer to like elements wherein.

DETAILED DESCRIPTION

Hereinafter, embodiments will be described with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
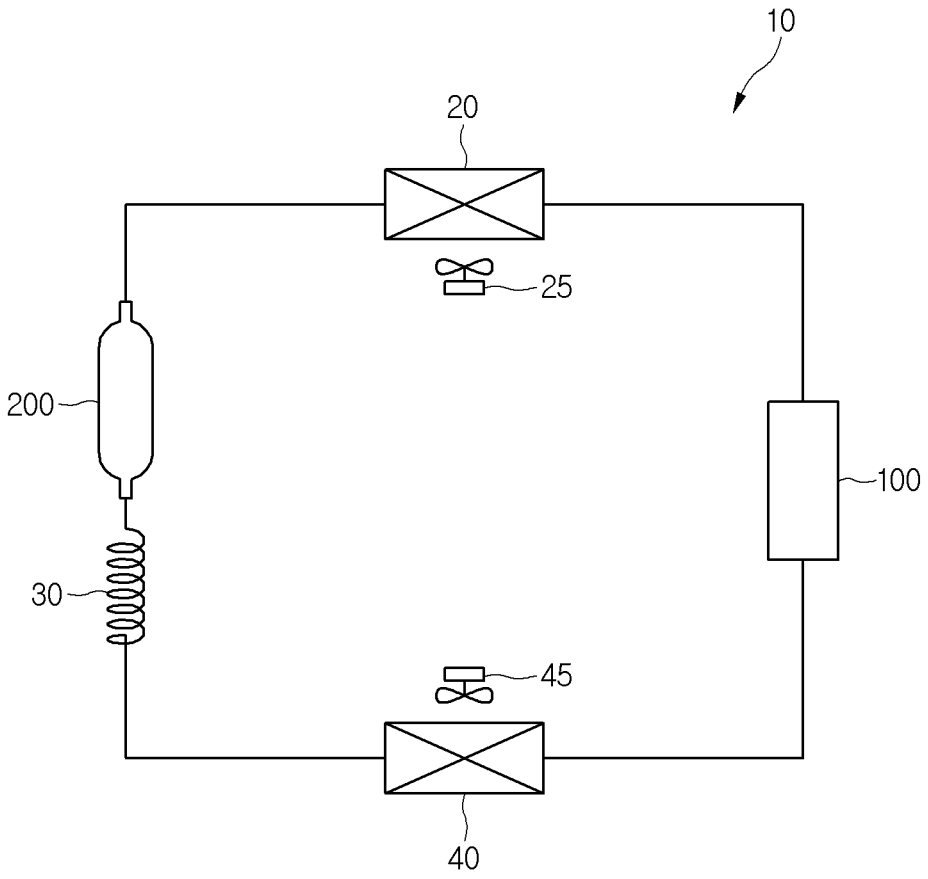
FIG. 1 is a schematic diagram of a refrigerator according to an embodiment.

FIG. 1 is a schematic diagram of a refrigerator according to an embodiment. Referring to FIG. 1, a refrigerator 10 according to an embodiment may include a cooling system to drive a refrigeration cycle. The cooling system may include a plurality of devices or components.

The cooling system may include a compressor 100 that compresses a refrigerant, a condenser 20 that condenses the refrigerant compressed in the compressor 100, a dryer 200 that removes moisture, foreign substances, or oil from the refrigerant condensed in the condenser 20, an expansion device 30 that decompresses the refrigerant passing through the dryer 200, and an evaporator 40 that evaporates the refrigerant decompressed in the expansion device 30. The cooling system may further include a condensation fan 25 to blow air toward the condenser 20, and an evaporation fan 45 to blow air toward the evaporator 40.

The compressor 100 may be a linear compressor, in which a piston may be directly connected to a motor to compress the refrigerant while the piston is linearly reciprocated within a cylinder. The expansion device 30 may include a capillary tube having a relatively small diameter.

A liquid refrigerant condensed in the condenser 20 may be introduced into the dryer 200. A gaseous refrigerant may be partially contained in the liquid refrigerant. A filter to filter the liquid refrigerant introduced into the dryer 200 may be provided in the dryer 200. Hereinafter, components of the dryer 200 will be described with reference to the accompanying drawings.

Figure 2:
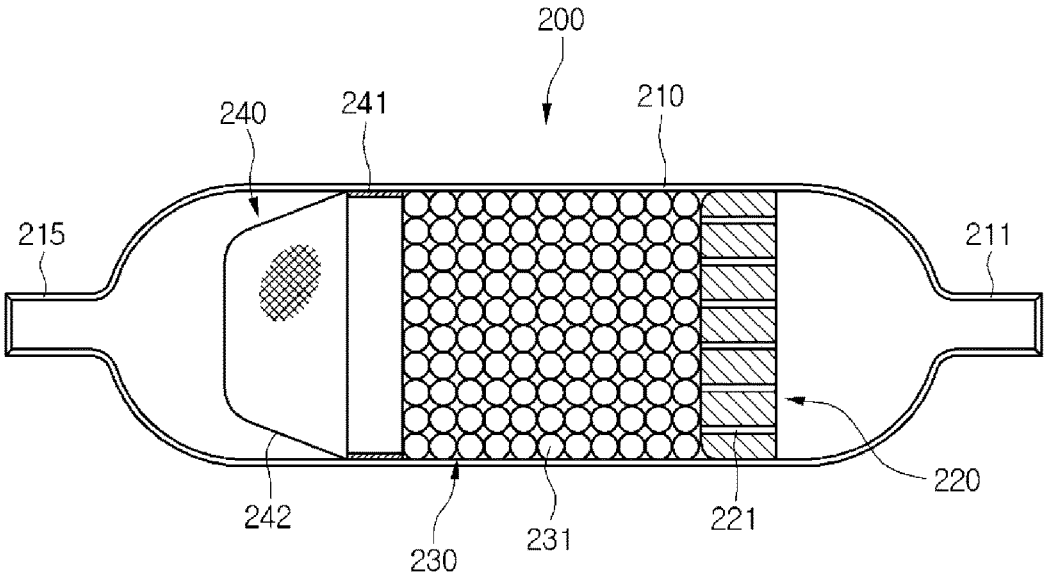
FIG. 2 is a view of a dryer of a refrigerator according to an embodiment.
Figure 3:
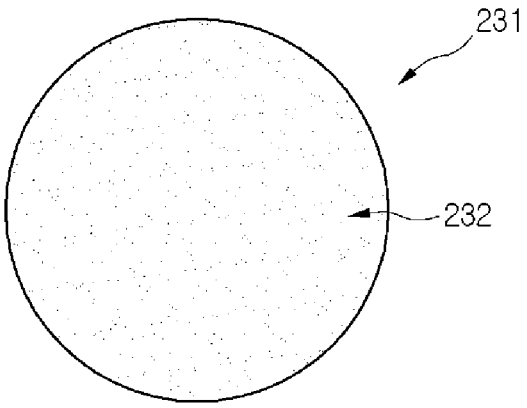
FIG. 3 is a view of an adsorbent provided in the dryer according to an embodiment.
Figure 4:
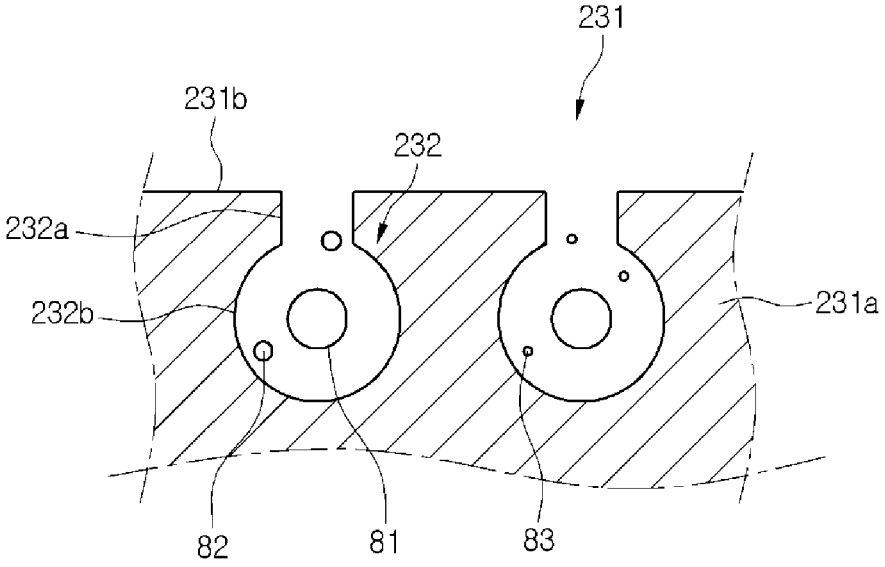
FIG. 4 is a cross-sectional view of the adsorbent of FIG. 3.

FIG. 2 is a view of a dryer of a refrigerator according to an embodiment. FIG. 3 is a view of an adsorbent provided in the dryer according to an embodiment. FIG. 4 is a cross-sectional view of the adsorbent of FIG. 3.

Referring to FIG. 2, the dryer 200 according to an embodiment may include a dryer body 210 that defines a flow space for the refrigerant, a refrigerant inflow 211 disposed on or at one or a first side of the dryer body 210 to guide introduction of the refrigerant, and a refrigerant discharge 215 disposed on or at the other or a second side of the dryer body 210 to guide discharge of the refrigerant. For example, the dryer body 210 may have a long cylindrical shape.

Dryer filters 220, 230, and 240 may be provided in the dryer body 210. The dryer filters 220, 230, and 240 may include a first dryer filter 220 disposed adjacent to the refrigerant inflow 211, a third dryer filter 240 spaced apart from the first dryer filter 220 and disposed adjacent to the refrigerant discharge 215, and a second dryer filter 230 disposed between the first dryer filter 220 and the third dryer filter 240 as an "adsorption filter".

The first dryer filter 220 may be disposed adjacent to an inside of the refrigerant inflow 211, that is, at a position closer to the refrigerant inflow 211 than the refrigerant discharge 215. The first dryer filter 220 may have an approximately hemispherical shape. An outer circumferential surface of the first dryer filter 220 may be coupled to an inner circumferential surface of the dryer body 210. A plurality of through holes 221 to guide a flow of the refrigerant may be defined in the first dryer filer 220. A foreign substance having a relatively large volume or size may be filtered by the first dryer filter 220 without passing through the plurality of through holes 221.

The second dryer filter 230 may include a plurality of adsorbents 231. Each of the adsorbents 231 may be a grain having a predetermined size or diameter. Each of adsorbent 231 may be a molecular sieve and have a predetermined size or diameter of about 5 mm to about 10 mm. A plurality of adsorption grooves (see reference numeral 232 of FIG. 4) to adsorb oil may be defined in the adsorbent 231.

The term "oil" may refer to a working oil or cutting oil injected when the plurality of devices forming the cooling system are manufactured or processed. For example, the working oil or cutting oil may be used to facilitate performance of processes and prevent the devices from being damaged when the plurality of devices forming the cooling system are manufactured, processed, or assembled. A predetermined amount of oil may remain even though a cleaning process is performed. Thus, after the devices are completely installed, the oil may be mixed with the refrigerant circulated in the cooling system.

Each adsorption groove 232 may have a size similar to or slightly greater than a size of the oil. On the other hand, each adsorption groove 232 may have a size greater than a size of the moisture or the refrigerant.

As each of the moisture and the refrigerant has a size less than the size of the adsorption groove 232, the refrigerant and moisture passing through the first dryer filter 220 may be easily discharged even though the refrigerant and moisture are easily introduced into the plurality of adsorption grooves 232 while passing through the adsorbents 231. Thus, the refrigerant and moisture may not be easily adsorbed onto or into the adsorbents 231.

However, as the oil has a size similar to the size of the adsorption groove 232, if the oil is introduced into the plurality of holes, the oil may not be easily discharged, and thus, may be adsorbed onto or into the adsorbents 231. As a result, the oil contained in the refrigerant may be adsorbed onto or into the plurality of adsorbents 231 while passing through the second dryer filter 230.

For example, the adsorbent 231 may include a BASF 13× molecular sieve. The adsorption groove 232 defined in the BASF 13× molecular sieve may have a size of about 9 Å to about 11 Å, and the BASF 13× molecular sieve may be expressed as a chemical formula: $Na_2O.Al_2O_3.mSiO_2.nH_2O$ ($m \leq 2.35$).

The third dryer filter 240 may include a coupling portion 241 coupled to the inner circumferential surface of the dryer body 210, and a mesh 242 that extends from the coupling portion 241 toward the refrigerant discharge 215. The third dryer filter 240 may be referred to as a mesh filter.

A foreign substance having a fine size contained in the refrigerant may be filtered by the mesh 242. Thus, it may prevent the expansion device 300 from being blocked by the refrigerant flowing into the expansion device 30 after passing through the dryer 200.

Each of the first dryer filter 220 and the third dryer filter 240 may serve as a support to locate the plurality of adsorbents 231 within the dryer body 210. That is, separation of the plurality of adsorbents 231 from the dryer 200 may be restricted by the first and third dryer filters 220 and 240.

As described above, the filters may be provided in the dryer 200 to remove foreign substances or oil contained in the refrigerant, thereby improving reliability of the refrigerant that acts as a gas bearing.

The adsorbent 231 will be described hereinbelow with reference to FIGS. 3 and 4.

The adsorbent 231 may include an adsorption body 231*a* having an adsorption surface 231*b*, and the plurality of adsorption grooves 232 recessed from the adsorption surface 231*b* of the adsorption body 231*a* toward an inside of the adsorbent 231 to adsorb oil. The adsorption body 231*a* may have an approximately globular shape. Also, the plurality of adsorption grooves 232 may be defined to be spaced apart from each other.

Each of the adsorption grooves 232 may include an inlet 232*a* to guide introduction of the oil contained in the refrigerant, and an oil adsorption portion 232*b* to store the oil. The inlet 232*a* may be recessed from the adsorption surface 231*b* toward the inside of the adsorption body 231*a* and have a predetermined size or diameter. The oil adsorption portion 232*b* may be further recessed from the inlet 232*a* toward the inside of the adsorption body 231*a*.

An oil particle 81, a refrigerant particle 82, and a moisture particle 83, which may be introduced into the dryer 200, may be introduced into the oil adsorption portion 232*b* through the inlet 232*a*. The inlet 232*a* may have a size or diameter greater than a size or diameter of each of the oil particle 81, the refrigerant particle 82, and the moisture particle 83. For example, the oil particle 81 may have a size of about 9 Å to about 10 Å, the refrigerant particle may have a size of about 4.0 Å to about 4.3 Å (in case of R134a, about 4.0 Å, and in case of R600a, about of 4.3 Å), and the moisture particle 83 may have a size of about 2.8 Å to about 3.2 Å). The inlet 232*a* may have a size or diameter of about 9 Å to about 11 Å.

As described above, the inlet 232*a* may have a size or diameter similar to or slightly greater than the oil particle 81. Also, the inlet 232*a* may have a size sufficiently greater than a size of each of the refrigerant particle 82 and the moisture particle 83.

Thus, while the oil particle 81, the refrigerant particle 82, and the moisture particle 83 pass through the adsorbent 231, the refrigerant particle 82 and the moisture particle 83 may be freely introduced into or discharged from the oil adsorption portion 232*b* through the inlet 232*a*. That is, adsorption of the refrigerant particle 82 and the moisture particle 83 onto or into the adsorption grooves 232 may be restricted.

On the other hand, the oil particle 81 may not be easily discharged to the outside through the inlet 232*a* when the oil particle 81 is introduced into the oil adsorption portion 232*b* through the inlet 232*a*. Thus, the oil particle 81 may be stably adsorbed onto or into the adsorption groove 232.

Figure 5:
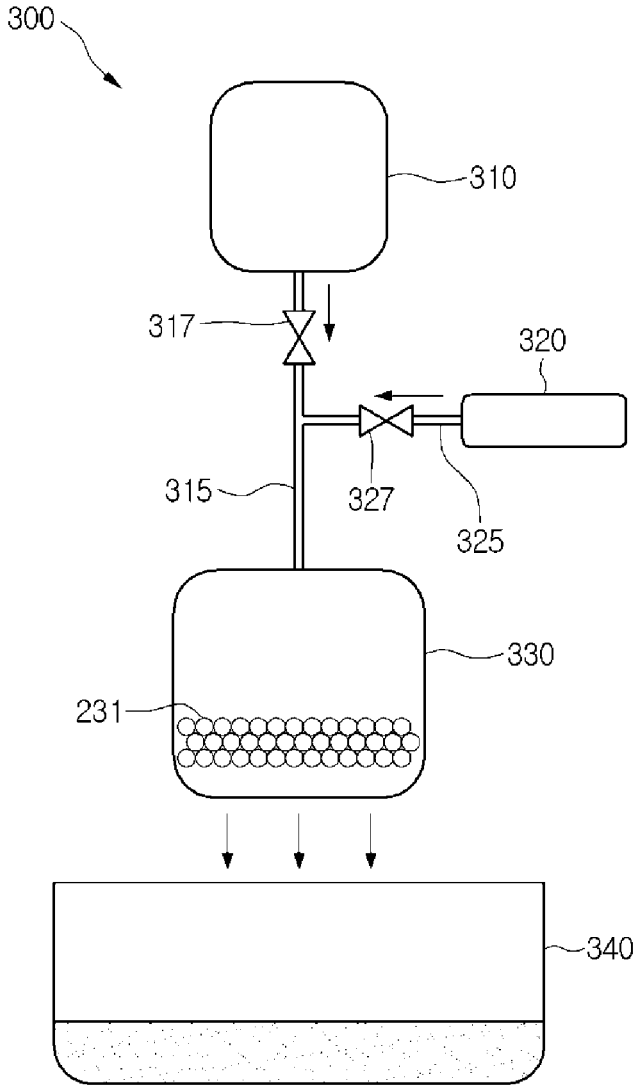
FIG. 5 is a schematic diagram of an oil adsorption test device for the adsorbent according to an embodiment.
Figure 6:
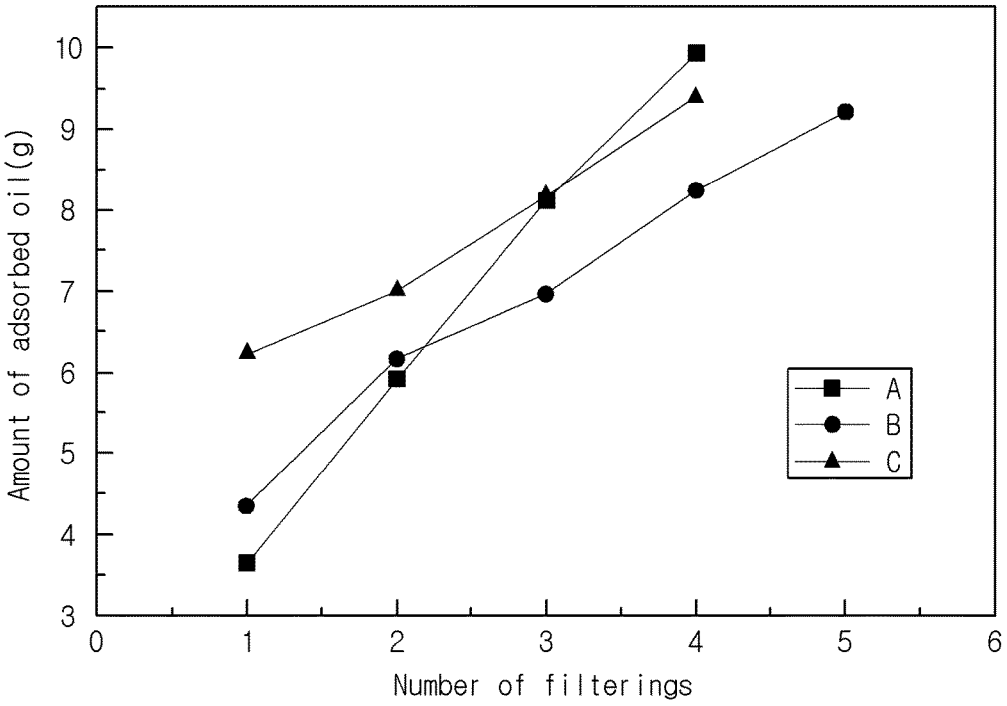
FIG. 6 is a graph illustrating a test result obtained by the oil adsorption test device of FIG. 5.

FIG. 5 is a schematic diagram of an oil adsorption test device for the adsorbent according to an embodiment. FIG. 6 is a graph illustrating a test result obtained by the oil adsorption test device of FIG. 5.

Referring to FIG. 5, an adsorption test device 300 to confirm an oil adsorption effect of the adsorbent 231 according to an embodiment may be used. The adsorption test device 300 may include an oil tank 310 to store oil, which is an object to be adsorbed, an adsorbent tank 330, into which the oil of the oil tank 310 may be introduced and including the plurality of adsorbents 231, and an inflow tube 315 that extends from the oil tank 310 toward the adsorbent tank 330. The adsorption test device 300 may further include a refrigerant tank 320 to store the refrigerant, and a refrigerant tube 325 that extends from the refrigerant tank 320 toward the inflow tube 315.

A first valve 317 to adjust an amount of oil discharged from the oil tank 310 may be disposed in the inflow tube 315, and a second valve 327 to adjust an amount of refrigerant discharged from the refrigerant tank 320 may be disposed in the refrigerant tube 325. When the first valve 317 is opened, oil in the oil tank 310 may be introduced into the adsorbent tank 330 via the oil tube 315. When the second valve 327 is opened, refrigerant in the refrigerant tank 320 may be mixed with the oil of the inflow tube 315 via the refrigerant tube 325. An opening time or degree of the first valve 317 may be controlled so that a preset or predetermined amount of oil may be introduced into the adsorbent tank 330.

The oil and refrigerant, which may be mixed with each other, may be introduced into the adsorbent tank 330 to pass through the plurality of adsorbents 231. The oil may be adsorbed onto or into the plurality of adsorption grooves 232 defined in each adsorbent 231.

The adsorption test device 300 may further include a residue tank 340 to store residue of the oil and refrigerant, which pass through the adsorbent tank 330. High-temperature water may be injected into the residue stored in the residue tank 340 to cook in a double boiler. The refrigerant may be evaporated (at a boiling point of about 40° C.) and then, may be separated from the oil. Thus, only the oil may remain in the residue tank 340.

Thus, the amount of oil remaining in the residue tank 340 may be measured. Thus, an amount of oil filtered by the plurality of adsorbents 231 may be measured using the measured residual amount of oil and the amount of oil introduced into the adsorbent tank 330. This measuring method may be performed several times.

FIG. 6 is a view illustrating a state in which an amount of adsorbed oil increases depending on a number of filterings according to the above-described measuring method. Referring to FIG. 6, three oils A, B, and C were used in the test. The oils included working oil (drawing oil and cutting oil) used when the plurality of devices provided in the cooling system are installed. Also, about 10 g of each of the oils was injected, and about 60 g of the adsorbent 231 was used as a BASF 13× molecular sieve.

For all of the oils A, B, and C, it is seen that the greater the number of filterings, the greater an amount of oil adsorbed onto or into the adsorbent 231. Further, in the case of oils A and C, when the filtering is performed four times, almost all of the oil may be filtered. In case of oil B, when the filtering is performed five times, almost all of the oil may be filtered.

As described above, it is seen that a filtering effect of the oil contained in the refrigerant is superior when the adsorbent 231 is applied to the dryer 200. In particular, when the refrigeration cycle operates in the cooling system, the refrigerant may be continuously circulated and filtered several times in the dryer 200. Thus, almost all of the oil contained in the refrigerant may be filtered.

Figure 7:
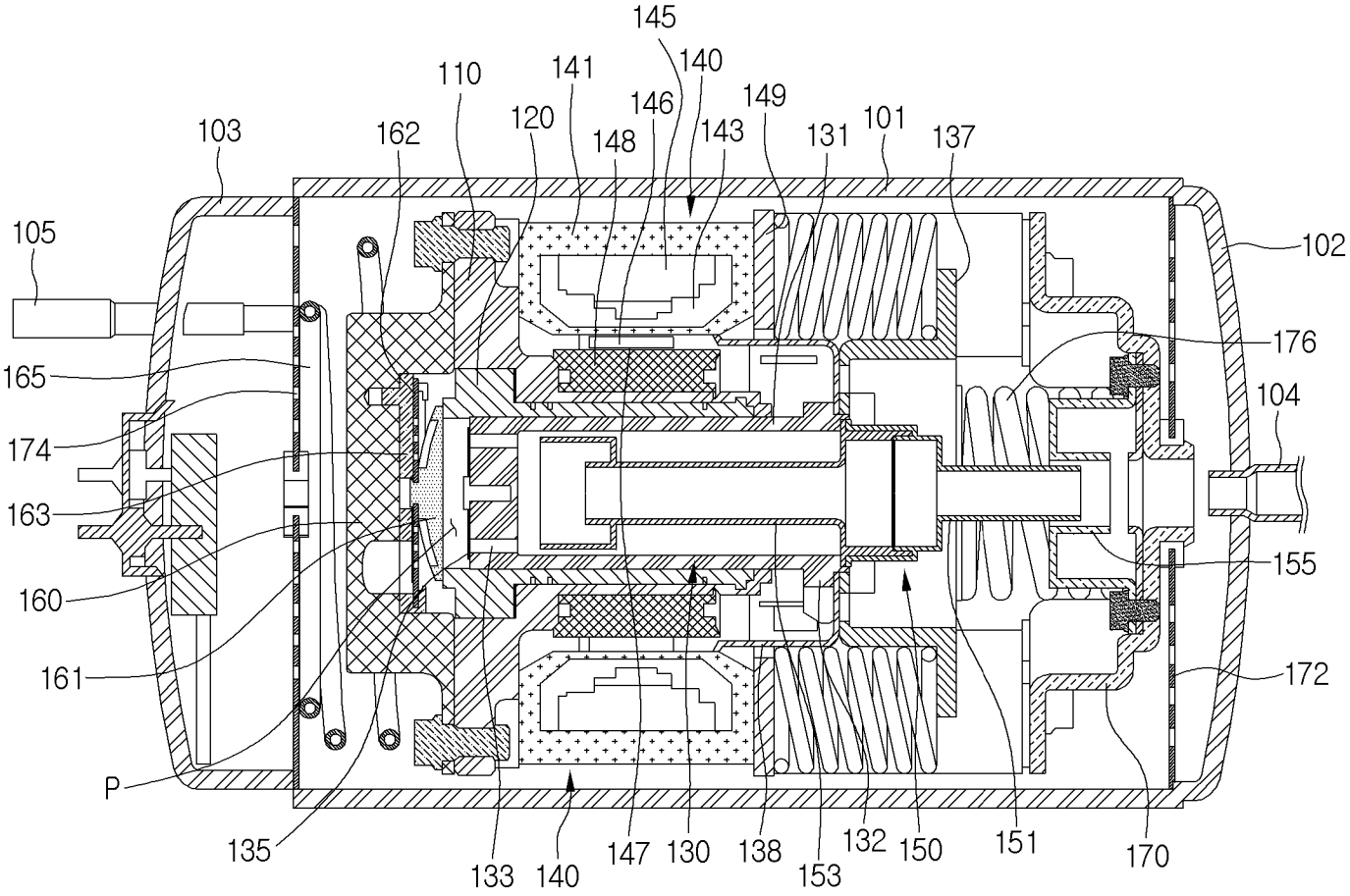
FIG. 7 is a cross-sectional view of a linear compressor according to an embodiment.

FIG. 7 is a cross-sectional view of a linear compressor according to an embodiment. Referring to FIG. 7, the linear compressor 100 according to an embodiment may include a shell 101 having an approximately cylindrical shape, a first cover 102 coupled to one or a first side of the shell 101, and a second cover 103 coupled to the other or a second side of the shell 101. For example, the linear compressor 100 may be laid out in a horizontal direction. The first cover 102 may be coupled to a right or first lateral side of the shell 101, and the second cover 103 may be coupled to a left or second lateral side of the shell 101. Each of the first and second covers 102 and 103 may be understood as one component of the shell 101.

The linear compressor 100 may further include a cylinder 120 provided in the shell 101, a piston 130 linearly reciprocated within the cylinder 120, and a motor assembly 140 that serves as a linear motor to apply a drive force to the piston 130. When the motor assembly 140 operates, the piston 130 may be linearly reciprocated at a high rate. The linear compressor 100 according to this embodiment may have a drive frequency of about 100 Hz.

In detail, the linear compressor 100 may include a suction inlet 104, through which the refrigerant may be introduced, and a discharge outlet 105, through which the refrigerant compressed in the cylinder 120 may be discharged. The suction inlet 104 may be coupled to the first cover 102, and the discharge outlet 105 may be coupled to the second cover 103.

The refrigerant suctioned in through the suction inlet 104 may flow into the piston 130 via a suction muffler 150. While the refrigerant passes through the suction muffler 150, noise may be reduced. The suction muffler 150 may be configured by coupling a first muffler 151 to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a nonmagnetic material, such as an aluminum material, such as aluminum or an aluminum alloy. As the piston 130 is formed of the aluminum material, a magnetic flux generated in the motor assembly 140 may not be transmitted into the piston 130, and thus, may be prevented from leaking outside of the piston 130. Also, as the piston 130 has a low weight, the piston 130 may be easily reciprocated. The piston 130 may be manufactured by a forging process, for example.

The cylinder 120 may be formed of a nonmagnetic material, such as an aluminum material, such as aluminum or an aluminum alloy. Also, the cylinder 120 and the piston 130 may have a same material composition, that is, a same kind and composition.

As the cylinder 120 may be formed of the aluminum material, a magnetic flux generated in the motor assembly 200 may not be transmitted into the cylinder 120, and thus, may be prevented from leaking outside of the cylinder 120. The cylinder 120 may be manufactured by an extruding rod processing process, for example.

Also, as the piston 130 may be formed of the same material (aluminum) as the cylinder 120, the piston 130 may have a same thermal expansion coefficient as the cylinder 120. When the linear compressor 100 operates, an high-temperature (a temperature of about 100° C.) environment may be created within the shell 100. Thus, as the piston 130 and the cylinder 120 have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 430 moves.

The cylinder 120 may accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in or at a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 160 that defines a discharge space or discharge passage for the refrigerant discharged from the compression space P, and a discharge valve assembly 160, 162, and 163 coupled to the discharge cover 160 to selectively discharge the refrigerant compressed in the compression space P may be provided at a front side of the compression space P. The discharge valve assembly 161, 162, and 163 may include a discharge valve 161 to introduce the refrigerant into the discharge space of the discharge cover 160 when a pressure within the compression space P is above a predetermined discharge pressure, a valve spring 162 disposed between the discharge valve 161 and the discharge cover 160 to apply an elastic force in an axial direction, and a stopper 163 that restricts deformation of the valve spring 162.

The term "compression space P" may be refer to as a space defined between the suction valve 135 and the discharge valve 161. The term "axial direction" may refer to a direction in which the piston 130 is reciprocated, that is, a transverse direction in FIG. 7. In the axial direction, a direction from the suction inlet 104 toward the discharge outlet 105, that is, a direction in which the refrigerant flows, may be defined as a "frontward direction", and a direction opposite to the frontward direction may be defined as a "rearward direction". On the other hand, the term "radial direction" may refer to a direction perpendicular to the direction in which the piston 130 is reciprocated, that is, a horizontal direction in FIG. 7.

The stopper 163 may be seated on the discharge cover 160, and the valve spring 162 may be seated at a rear side of the stopper 163. The discharge valve 161 may be coupled to the valve spring 162, and a rear portion or rear surface of the discharge valve 161 may be supported by a front surface of the cylinder 120. The valve spring 162 may include a plate spring, for example.

The suction valve 135 may be disposed on or at one or a first side of the compression space P, and the discharge valve 161 maybe disposed on or at the other or a second side of the compression space P, that is, a side opposite of the suction valve 135. While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the refrigerant may be compressed in the compression space P in a state in which the suction valve 135 is closed.

When the pressure of the compression space P is above the predetermined discharge pressure, the valve spring 162 may be deformed to open the discharge valve 161. The refrigerant may be discharged from the compression space P into the discharge space of the discharge cover 160.

The refrigerant flowing into the discharge space of the discharge cover 160 may be introduced into a loop pipe 165. The loop pipe 165 may be coupled to the discharge cover 160 to extend to the discharge outlet 105, thereby guiding the compressed refrigerant in the discharge space into the discharge outlet 105. For example, the loop pipe 165 may have a shape that is wound in a predetermined direction and extends in a rounded shape. The loop pipe 165 may be coupled to the discharge outlet 105.

The linear compressor 100 may further includes a frame 110. The frame 110 may fix the cylinder 120 and be coupled to the cylinder 120 by a separate coupling member, for example. The frame 110 may surround the cylinder 120. That is, the cylinder 120 may be accommodated within the frame 110. Also, the discharge cover 160 may be coupled to a front surface of the frame 110.

At least a portion of the high-pressure gas refrigerant discharged through the opened discharge valve 161 may flow toward an outer circumferential surface of the cylinder 120 through a space at a portion at which the cylinder 120 and the frame 110 are coupled to each other. The refrigerant may be introduced into the cylinder 120 through one or more gas inflow (see reference numeral 122 of FIG. 13) and one or more nozzle (see reference numeral 123 of FIG. 13), which may be defined in the cylinder 120. The introduced refrigerant may flow into a space defined between the piston 130 and the cylinder 120 to allow an outer circumferential surface of the piston 130 to be spaced apart from an inner circumferential surface of the cylinder 120. Thus, the introduced refrigerant may serve as a "gas bearing" that reduces friction between the piston 130 and the cylinder 120 while the piston 130 is reciprocated.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be a single magnet having one polarity, or a plurality of magnets having three polarities.

The permanent magnet 146 may be coupled to the piston 130 by a connection member 138, for example. In detail, the connection member 138 may be coupled to the piston flange 132 and be bent to extend toward the permanent magnet 146. As the permanent magnet 146 is reciprocated, the piston 130 may be reciprocated together with the permanent magnet 146 in the axial direction.

The motor assembly 140 may further include a fixing member 147 to fix the permanent magnet 147 to the connection member 138. The fixing member 147 may be formed of a composition in which a glass fiber or carbon fiber is mixed with a resin. The fixing member 147 may be provided to surround an outside of the permanent magnet 146 to firmly maintain a coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 145. The coil 145 may have a polygonal cross-section, for example, a hexagonal cross-section. The stator core 141 may be manufactured by stacking a plurality of laminations in a circumferential direction and be disposed to surround the coil winding bodies 143 and 145.

A stator cover 149 may be disposed on or at one side of the outer stators 141, 143, and 145. One or a first side of the outer stators 141, 143, and 145 may be supported by the frame 110, and the other or a second side of the outer stators 141, 143, and 145 may be supported by the stator cover 149.

The inner stator 148 may be fixed to a circumference of the frame 110. Also, in the inner stator 148, a plurality of laminations may be stacked in a circumferential direction outside of the frame 110.

The linear compressor 100 may further include a support 137 that supports the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction inlet 104 to introduce the refrigerant into the suction muffler 150.

The linear compressor 100 may further include a plurality of springs 176, which are adjustable in natural frequency, to allow the piston 130 to perform a resonant motion. The plurality of springs 176 may include a first spring supported between the support 137 and the stator cover 149, and a second spring supported between the support 137 and the back cover 170.

The linear compressor 100 may further include plate springs 172 and 174, respectively, disposed on both lateral sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 8:
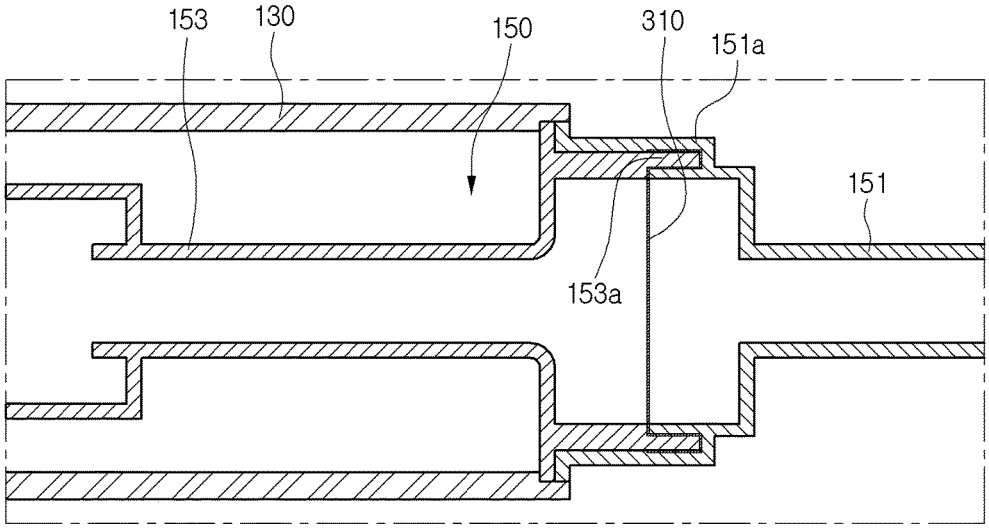
FIG. 8 is a cross-sectional view of a suction muffler according to an embodiment.

FIG. 8 is a cross-sectional view of a suction muffler according to an embodiment. Referring to FIG. 8, the suction muffler 150 according to this embodiment may include the first muffler 151, the second muffler 153 coupled to the first muffler 151, and a first filter 310 supported by the first and second mufflers 151 and 153.

A flow space, in which the refrigerant may flow may be defined in each of the first and second mufflers 151 and 153. The first muffler 151 may extend from an inside of the suction inlet 104 in a direction of the discharge outlet 105, and at least a portion of the first muffler 151 may extend inside of the suction guide 155. The second muffler 153 may extend from the first muffler 151 to an inside of the piston body 131.

The first filter 310 may be disposed in the flow space to filter foreign substances. The first filter 310 may be formed of a material having a magnetic property. Thus, the foreign substances contained in the refrigerant, in particular, metallic substances, may be easily filtered. The first filter 310 may be formed of stainless steel, for example, and thus, have a magnetic property to prevent the first filter 310 from rusting. As another example, the first filter 310 may be coated with a magnetic material, or a magnet may be attached to a surface of the first filter 310.

The first filter 310 may be a mesh-type structure and have an approximately circular plate shape. Each filter hole of the first filter 310 may have a diameter or width less than a predetermined diameter or width. For example, the predetermined size may be about 25 μm.

The first muffler 151 and the second muffler 153 may be assembled with each other using a press-fit manner, for example. The first filter 310 may be fitted into a portion at which the first and second mufflers 151 and 153 are press-fitted together, and then, may be assembled. For example, a groove 151*a* may be provided in one of the first muffler 151 or the second muffler 153, and a protrusion 153*a* to be inserted into the groove 151*a* may be provided on the other one of the first muffler 151 or second muffler 153.

The first filter 310 may be supported by the first and second mufflers 151 and 153 in a state in which both sides of the first filter 310 are disposed between the groove 151*a* and the protrusion 153*a*. In a state in which the first filter 310 is disposed between the first muffler and the second muffler 153, when the first and second mufflers 151 and 153 move in a direction that approach each other and then are press-fitted together, both sides of the first filter 310 may be inserted and fixed between the groove 151*a* and the protrusion 153*a*.

As described above, as the first filter 310 may be provided on the suction muffler 150, a foreign substance having a size greater than a predetermined size in the refrigerant suctioned in through the suction inlet 104 may be filtered by the first filter 310. Thus, the first filter 310 may filter the foreign substance from the refrigerant acting as the gas bearing between the piston 130 and the cylinder 120 to prevent the foreign substance from being introduced into the cylinder 120. Also, as the first filter 310 may be firmly fixed to the portion at which the first and second mufflers 151 and 153 are press-fitted together, separation of the first filter 310 from the suction muffler 150 may be prevented.

Figure 9:
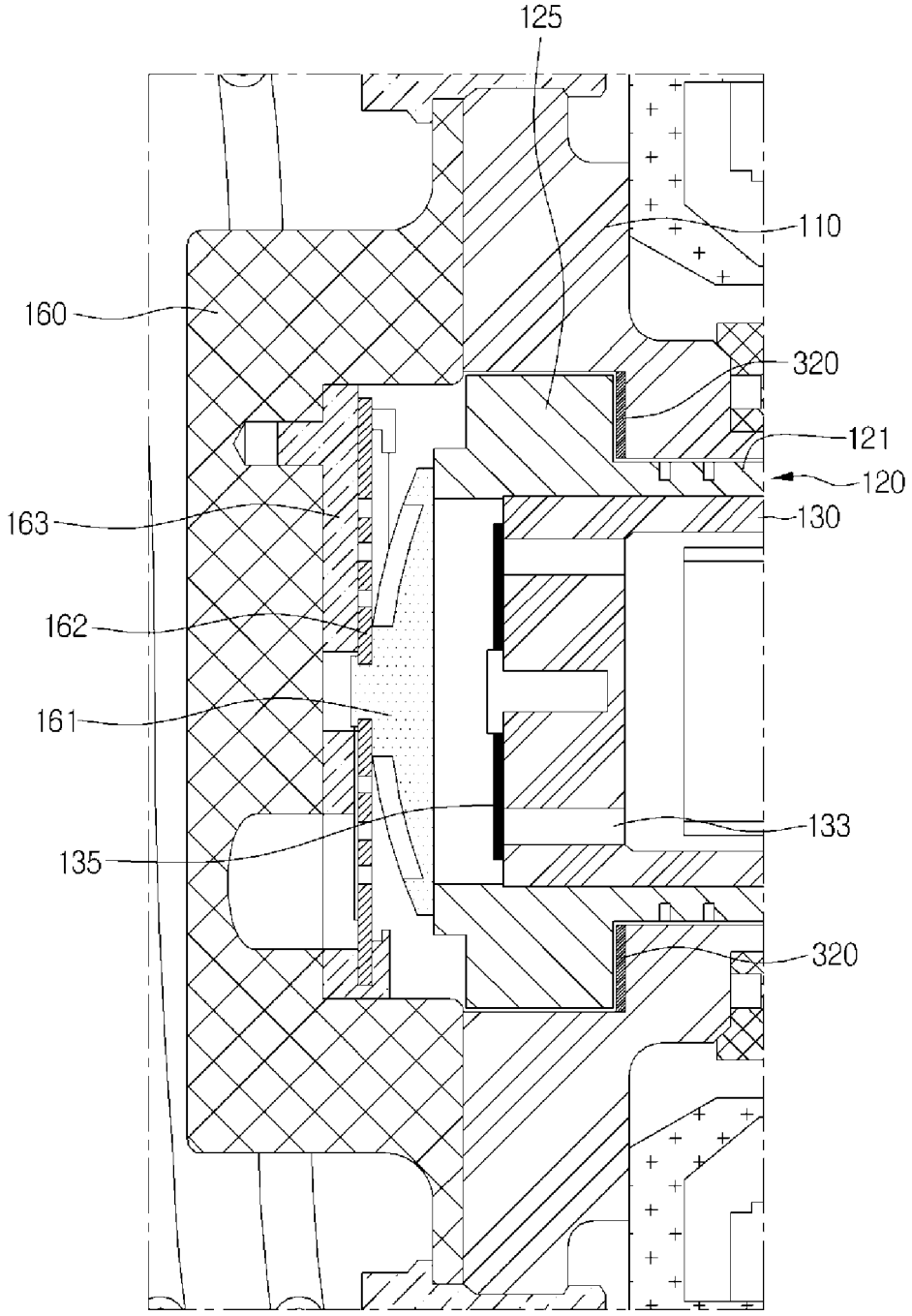
FIG. 9 is a cross-sectional view illustrating a position of a second filter according to an embodiment.
Figure 10:
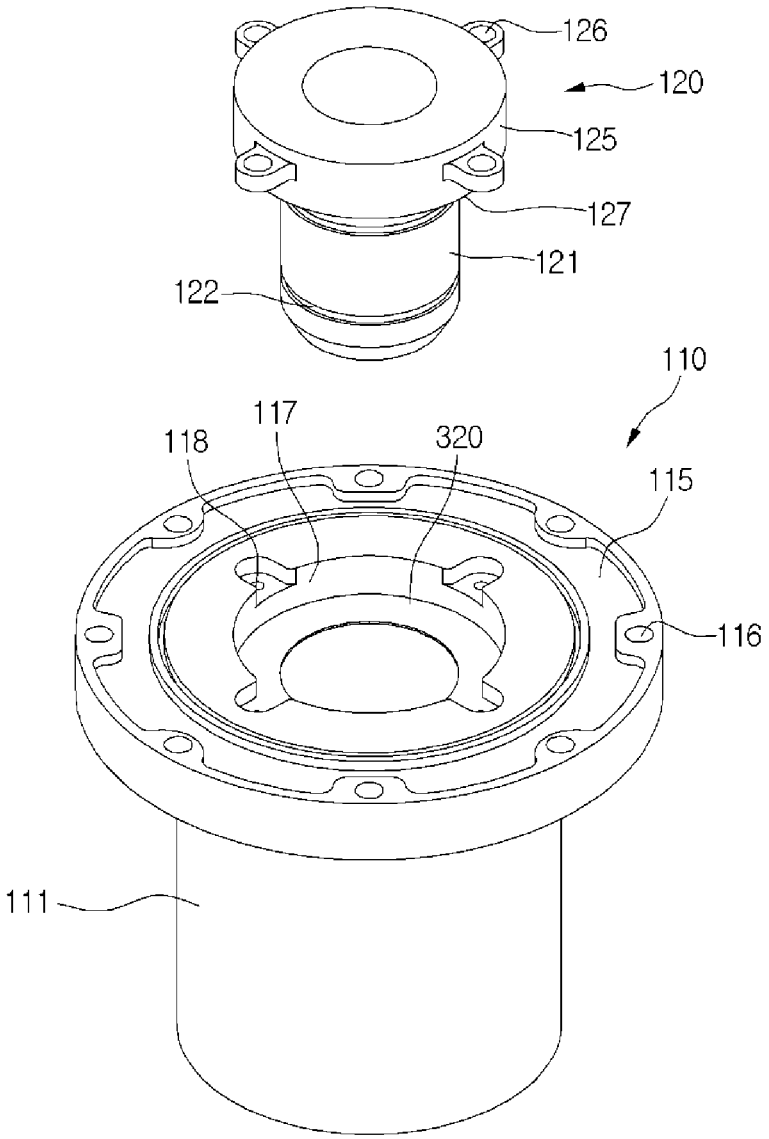
FIG. 10 is an exploded perspective view of a cylinder and a frame according to an embodiment.

FIG. 9 is a cross-sectional view illustrating a position of a second filter according to an embodiment. FIG. 10 is an exploded perspective view of a cylinder and a frame according to an embodiment.

Referring to FIGS. 9 and 10, the linear compressor 100 according to an embodiment may include a second filter 320 disposed between the frame 110 and the cylinder 120 to filter a high-pressure gas refrigerant discharged through the discharge valve 161. The second filter 320 may be disposed on or at a portion of a coupled surface at which the frame 110 and the cylinder 120 are coupled to each other.

In detail, the cylinder 120 may include a cylinder body 121 having an approximately cylindrical shape, and cylinder flange 125 that extends from the cylinder body 121 in a radial direction. The cylinder body 121 may includes the one or more gas inflow 122, through which the discharged gas refrigerant may be introduced. The gas inflow 122 may be recessed in an approximately circular shape along a circumferential surface of the cylinder body 121.

A plurality of the gas inflow 122 may be provided. The plurality of gas inflows 122 may include gas inflows (see reference numerals 122*a* and 122*b* of FIG. 12) disposed on one or a first side with respect to a center or central portion 121*c* of the cylinder body 121 in an axial direction, and a gas inflow (see reference numeral 122*c* of FIG. 12) disposed on the other or a second side with respect to the center or central portion 121*c* of the cylinder body 121 in the axial direction.

One or more coupling portion 126 coupled to the frame 110 may be disposed on the cylinder flange 125. Each coupling portion 126 may protrude outward from an outer circumferential surface of the cylinder flange 125, and be coupled to a cylinder coupling hole 118 of the frame 110 by a predetermined coupling member, for example.

The cylinder flange 125 may have a seat surface 127 seated on the frame 110. The seat surface 127 may be a rear surface of the cylinder flange 125 that extends from the cylinder body 121 in the radial direction.

The frame 110 may include a frame body 111 that surrounds the cylinder body 121, and a cover coupling portion 115 that extends in a radial direction of the frame body 121 and is coupled to the discharge cover 160. The cover coupling portion 115 may have a plurality of cover coupling holes 116, in which the coupling member coupled to the discharge cover 160 may be inserted, and a plurality of the cylinder coupling hole 118, in which the coupling member coupled to the cylinder flange 125 may be inserted. The plurality of cylinder coupling holes 118 may be defined at positions raised somewhat from the cover coupling portion 115.

The frame 110 may have a recess 117 recessed backward from the cover coupling portion 115 to allow the cylinder flange 125 to be inserted therein. That is, the recess 117 may be disposed to surround the outer circumferential surface of the cylinder flange 125. The recess 117 may have a recessed depth corresponding to a front/rear width of the cylinder flange 125.

A predetermined refrigerant flow space may be defined between an inner circumferential surface of the recess 117 and the outer circumferential surface of the cylinder flange 125. The high-pressure gas refrigerant discharged from the discharge valve 161 may flow toward the outer circumferential surface of the cylinder body 121 via the refrigerant flow space. The second filter 320 may be disposed in the refrigerant flow space to filter the refrigerant.

In detail, a seat having a stepped portion may be disposed on or at a rear end of the recess 117. The second filter 320, which may have a ring shape, may be seated on the seat.

In a state in which the second filter 320 is seated on the seat, when the cylinder 120 is coupled to the frame 110, the cylinder flange 125 may push the second filter 320 from a front side of the second filter 320. That is, the second filter 320 may be disposed and fixed between the seat of the frame 110 and the seat surface 127 of the cylinder flange 125.

The second filter 320 may prevent foreign substances in the high-pressure gas refrigerant discharged through the opened discharge valve 161 from being introduced into the gas inflow 122 of the cylinder 120 and be configured to adsorb oil contained in the refrigerant thereon or therein. For example, the second filter 320 may include a felt formed of polyethylene terephthalate (PET) fiber or an adsorbent paper. The PET fiber may have superior heat-resistance and mechanical strength. Also, a foreign substance having a size of about 2 μm or more, which is contained in the refrigerant, may be blocked.

The high-pressure gas refrigerant passing through the flow space defined between the inner circumferential surface of the recess 117 and the outer circumferential surface of the cylinder flange 125 may pass through the second filter 320. In this process, the refrigerant may be filtered by the second filter 320.

Figure 11:
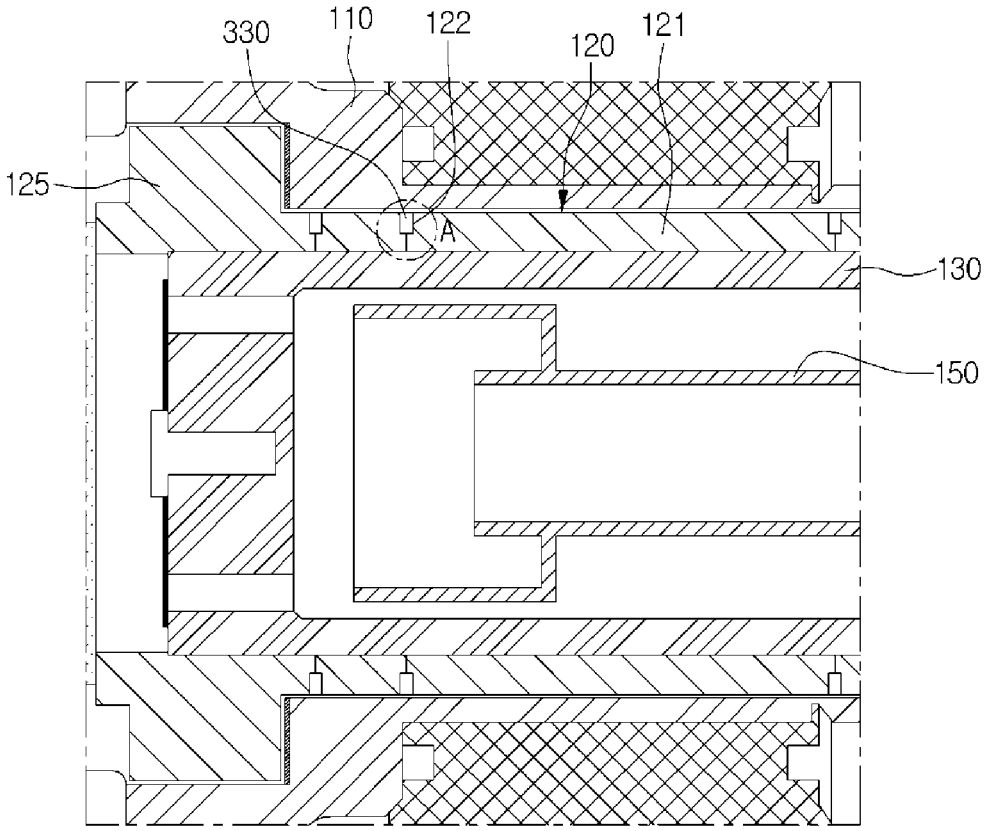
FIG. 11 is a cross-sectional view illustrating a state in which the cylinder and a piston are coupled to each other according to an embodiment.
Figure 12:
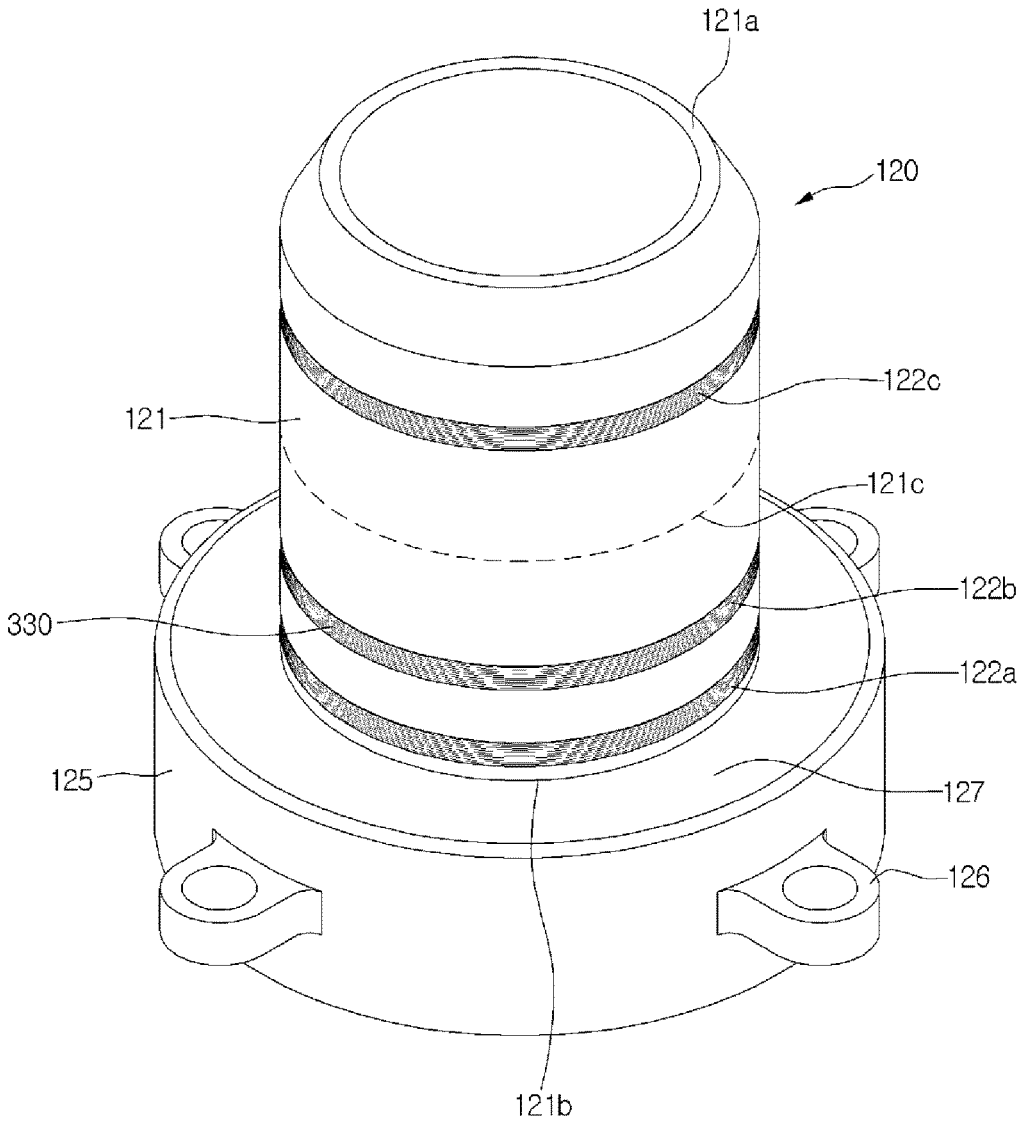
FIG. 12 is a view of the cylinder according to an embodiment.
Figure 13:
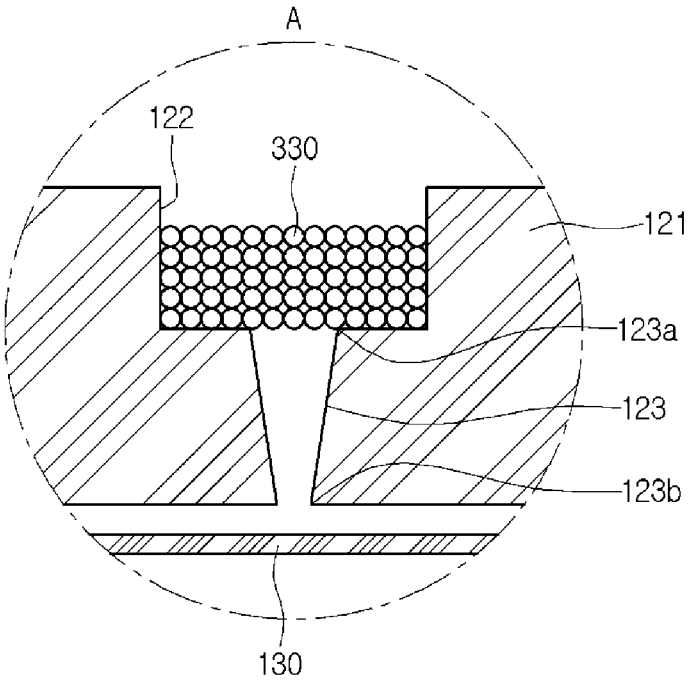
FIG. 13 is an enlarged cross-sectional view of portion A of FIG. 11.

FIG. 11 is a cross-sectional view illustrating a state in which the cylinder and a piston are coupled to each other according to an embodiment. FIG. 12 is a view of the cylinder according to an embodiment. FIG. 13 is an enlarged cross-sectional view of portion A of FIG. 11.

Referring to FIGS. 11 to 13, the cylinder 120 according to an embodiment may include the cylinder body 121 having an approximately cylindrical shape to form a first body end 121*a* and a second body end 121*b*, and the cylinder flange 125 that extend from the second body end 121*b* of the cylinder body 121 in the radial direction.

The first body end 121*a* and the second body end 121*b* form both ends of the cylinder body 121 with respect to the central portion 121*c* of the cylinder body 121 in an axial direction. The first body end 121*a* may define a rear end of the cylinder body 121, and the second body end 121*b* may define a front end of the cylinder body 121.

The cylinder body 121 may include a plurality of the gas inflows 122, through which at least a portion of the high-pressure gas refrigerant discharged through the discharge valve 161 may flow. A third filter 330 as a "filter member" may be disposed on the plurality of gas inflows 122.

Each of the plurality of gas inflows 122 may be recessed from the outer circumferential surface of the cylinder body 121 by a predetermined depth and width. The refrigerant may be introduced into the cylinder body 121 through the plurality of gas inflows 122 and the nozzle 123.

The introduced refrigerant may be disposed between the outer circumferential surface of the piston 130 and the inner circumferential surface of the cylinder 120 to serve as the gas bearing with respect to movement of the piston 130. That is, the outer circumferential surface of the piston 130 may be maintained in a state in which the outer circumferential surface of the piston 130 is spaced apart from the inner circumferential surface of the cylinder 120 by a pressure of the introduced refrigerant.

The plurality of gas inflows 122 may include first and second gas inflows 122*a* disposed on one or a first side with respect to the central portion 121*c* in an axial direction of the cylinder body 121, and a third gas inflow 122*c* disposed on the other or a second side with respect to the central portion 121*c* in the axial direction.

The first and second gas inflows 122*a* and 122*b* may be disposed at positions closer to the second body end 121*b* with respect to the central portion 121*c* in the axial direction of the cylinder body 121, and the third gas inflow 122*c* may be disposed at a position closer to the first body end 121*a* with respect to the central portion 121*c* in the axial direction of the cylinder body 121. That is, the plurality of gas inflows 122 may be provided in numbers that are not symmetrical to each other with respect to the central portion 121*c* in the axial direction of the cylinder body 121.

Referring to FIG. 10, the cylinder 120 may have a relatively high inner pressure at a side of the second body end 121*b*, which may be closer to a discharge-side of the compressed refrigerant, when compared to that of the first body end 121*a*, which may be closer to a suction-side of the refrigerant. Thus, more of the gas inflows 122 may be provided to or at the side of the second body end 121*b* to enhance a function of the gas bearing, and relatively less gas inflows 122 may be provided to or at the side of the first body end 121*a*.

The cylinder body 121 may further include the nozzle 123 that extends from the plurality of gas inflows 122 toward the inner circumferential surface of the cylinder body 121. Each nozzle 123 may have a width or size less than a width or size that of the gas inflow 122.

A plurality of the nozzle 123 may be provided along the gas inflow 122, which may extend in a circular shape. The plurality of nozzles 123 may be disposed to be spaced apart from each other.

Each nozzle 123 may include an inlet 123*a* connected to the gas inflow 122, and an outlet 123*b* connected to the inner circumferential surface of the cylinder body 121. Each nozzle 123 may have a predetermined length from the inlet 123*a* to the outlet 123*b*.

A recessed depth and width of each of the plurality of gas inflows 122 and a length of the nozzle 123 may be determined to have adequate dimensions in consideration of a rigidity of the cylinder 120, an amount of the third filter 330, or an intensity in pressure drop of the refrigerant passing through the nozzle 123. For example, if the recessed depth and width of each of the plurality of gas inflows 122 are very large, or the length of the nozzle 123 is very short, the rigidity of the cylinder 120 may be weak. On the other hand, if the recessed depth and width of each of the plurality of gas inflows 122 are very small, an amount of the third filter 330 provided in the gas inflow 122 may be very small. Also, if the length of the nozzle 123 is too long, the pressure drop of the refrigerant passing through the nozzle 123 may be too large, and it may be difficult to perform the function as the gas bearing.

The inlet 123*a* of the nozzle 123 may have a diameter greater than a diameter of the outlet 123*b*. In detail, if the diameter of the nozzle 123 is too small, an amount of refrigerant, which is introduced from the nozzle 123, of the high-pressure gas refrigerant discharged through the discharge valve 161 may be too large, increasing flow loss in the compressor. On the other hand, if the diameter of the nozzle 123 is too small, the pressure drop in the nozzle 123 may increase, reducing performance as the gas bearing.

Thus, in this embodiment, the inlet 123*a* of the nozzle 123 may have a relatively large diameter to reduce the pressure drop of the refrigerant introduced into the nozzle 123. In addition, the outlet 123*b* may have a relatively small diameter to control an inflow amount of gas bearing through the nozzle 123 to a predetermined value or less.

The third filter 330 may prevent a foreign substance having a predetermined size or more from being introduced into the cylinder 120 and perform a function to adsorb oil contained in the refrigerant. The predetermined size may be about 1 μm.

The third filter 330 may include a thread wound around the gas inflow 122. In detail, the thread may be formed of a polyethylene terephthalate (PET) material and have a predetermined thickness or diameter.

A thickness or diameter of the thread may be may be determined to have adequate dimensions in consideration of rigidity of the thread. If the thickness or diameter of the thread is too small, the thread may be easily broken due to a very weak strength thereof. On the other hand, if the thickness or diameter of the thread is too large, a filtering effect with respect to the foreign substances may be deteriorated due to a very large pore in the gas inflow 122 when the thread is wound.

For example, the thickness or diameter of the thread may have several hundreds μm. The thread may be manufactured by coupling a plurality of strands of a spun thread having several tens μm to each other, for example.

The thread may be wound several times, and an end of the thread may be fixed through a knot. The wound number of the thread may be adequately selected in consideration of the pressure drop of the gas refrigerant and the filtering effect with respect to the foreign substances. If the wound number of thread is too large, the pressure drop of the gas refrigerant may increase. On the other hand, if the wound number of thread is too little, the filtering effect with respect to the foreign substances may be reduced.

Also, a tension force of the wound thread may be adequately controlled in consideration of a strain of the cylinder and fixation of the thread. If the tension force is too large, deformation of the cylinder 120 may occur. On the other hand, if the tension force is too small, the thread may not be well fixed to the gas inflow 122.

Figure 14:
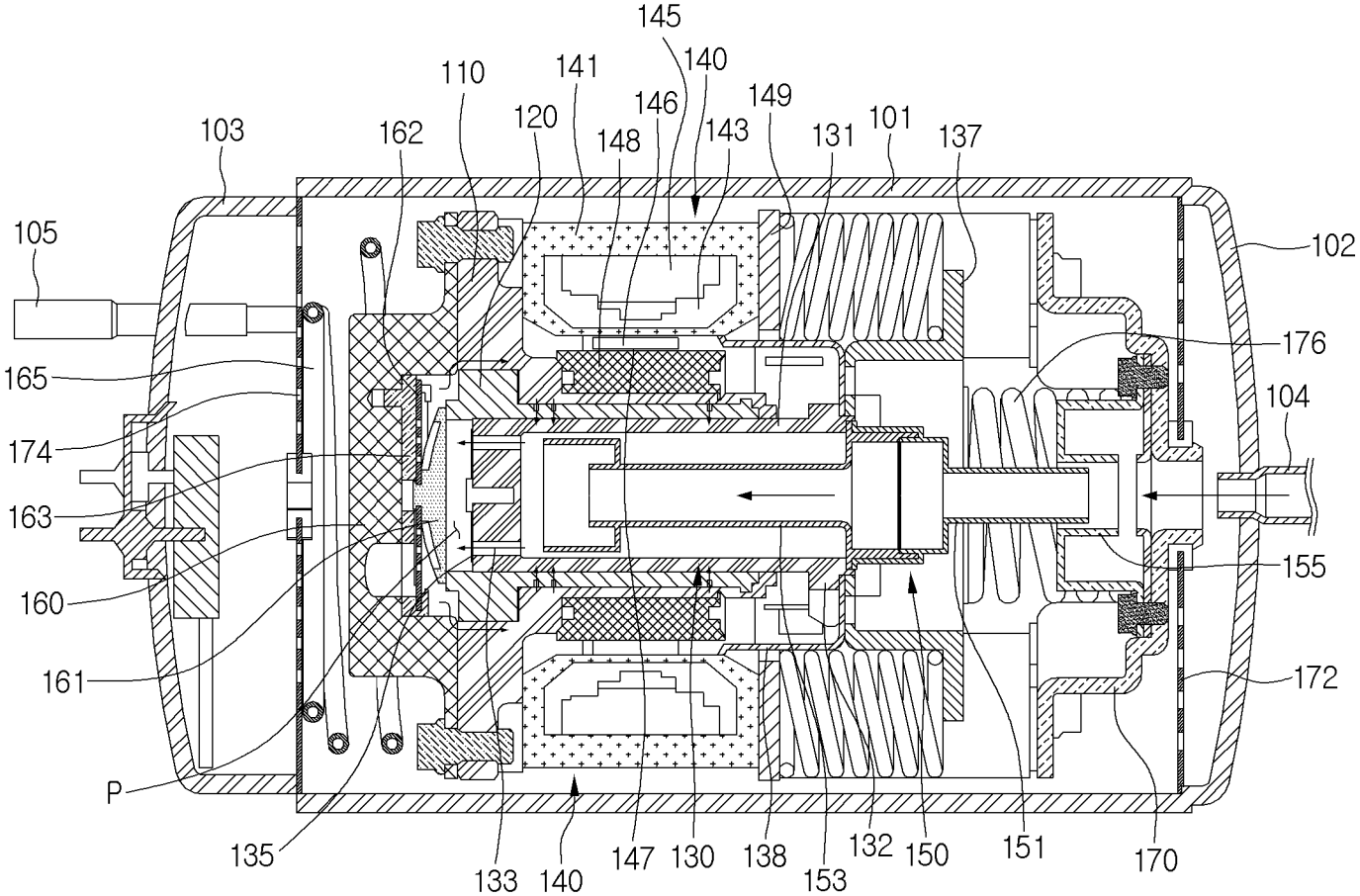
FIG. 14 is a cross-sectional view illustrating a refrigerant flow in the linear compressor according to an embodiment.

FIG. 14 is a cross-sectional view illustrating a refrigerant flow in the linear compressor according to an embodiment. Referring to FIG. 14, a refrigerant flow in the linear compressor according to an embodiment will be described hereinbelow.

Referring to FIG. 14, the refrigerant may be introduced into the shell 101 through the suction inlet 104 and flow into the suction muffler 150 through the suction guide 155. The refrigerant may be introduced into the second muffler 153 via the first muffler 151 of the suction muffler 150 to flow into the piston 130. In this way, suction noise of the refrigerant may be reduced.

A foreign substance having a predetermined size (about 25 μm) or more, which is contained in the refrigerant, may be filtered while passing through the first filter 310 provided on or in the suction muffler 150. The refrigerant within the piston 130 after passing though the suction muffler 150 may be suctioned into the compression space P through the suction hole 133 when the suction valve 135 is opened.

When the refrigerant pressure in the compression space P is above the predetermined discharge pressure, the discharge valve 161 may be opened. Thus, the refrigerant may be discharged into the discharge space of the discharge cover 160 through the opened discharge valve 161, flow into the discharge outlet 105 through the loop pipe 165 coupled to the discharge cover 160, and be discharged outside of the compressor 100.

At least a portion of the refrigerant within the discharge space of the discharge cover 160 may flow into a space defined between the cylinder 120 and the frame 110, that is, the flow space 210. In detail, the refrigerant may flow toward the outer circumferential surface of the cylinder body 121 via the flow space 210 defined between the inner circumferential surface of the recess 117 and the outer circumferential surface of the cylinder flange 125 of the cylinder 120.

The refrigerant may pass through the second filter 320 disposed between the seat surface 127 of the cylinder flange 125 and the seat 113 of the frame 110. In this way, a foreign substance having a predetermined size (about 2 μm) or more may be filtered. Also, oil in the refrigerant may be adsorbed onto or into the second filter 320.

The refrigerant passing through the second filter 320 may be introduced into the plurality of gas inflows 122 defined in the outer circumferential surface of the cylinder body 121. While the refrigerant passes through the third filter 330 provided on or in the plurality of gas inflows 122, a foreign substances having a predetermined size (about 1 μm) or more, which is contained in the refrigerant, may be filtered, and the oil contained in the refrigerant may be adsorbed.

The refrigerant passing through the third filter 330 may be introduced into the cylinder 120 through the nozzle(s) 123 and flow between the inner circumferential surface of the cylinder 120 and the outer circumferential surface of the piston 130 to space the piston 130 from the inner circumferential surface of the cylinder 120 (gas bearing).

As described above, the high-pressure gas refrigerant may be bypassed within the cylinder 120 to serve as the gas bearing with respect to the piston 130, which is reciprocated, thereby reducing abrasion between the piston 130 and the cylinder 120. Also, as oil is not used for the bearing, friction loss due to the oil may not occur even though the compressor 100 operates at a high rate.

Also, as the plurality of filters may be provided on or in the passage of the refrigerant flowing in the compressor 100, foreign substances contained in the refrigerant may be removed. Thus, the refrigerant acting as the gas bearing may be improved in reliability. Thus, it may prevent the piston 130 or the cylinder 120 from being worn by the foreign substances contained in the refrigerant.

Also, as the oil contained in the refrigerant is removed by the plurality of filters, friction loss due to oil may be prevented from occurring.

The first, second, and third filters 310, 320, and 330 may be referred to as a "refrigerant filter device" in that the filters 310, 320, and 330 filter the refrigerant that serves as the gas bearing.

Hereinafter, another embodiment will be described. This embodiment is the same as the previous embodiment except for an arrangement of a dryer filter, and thus, different points therebetween will be mainly described.

Figure 15:
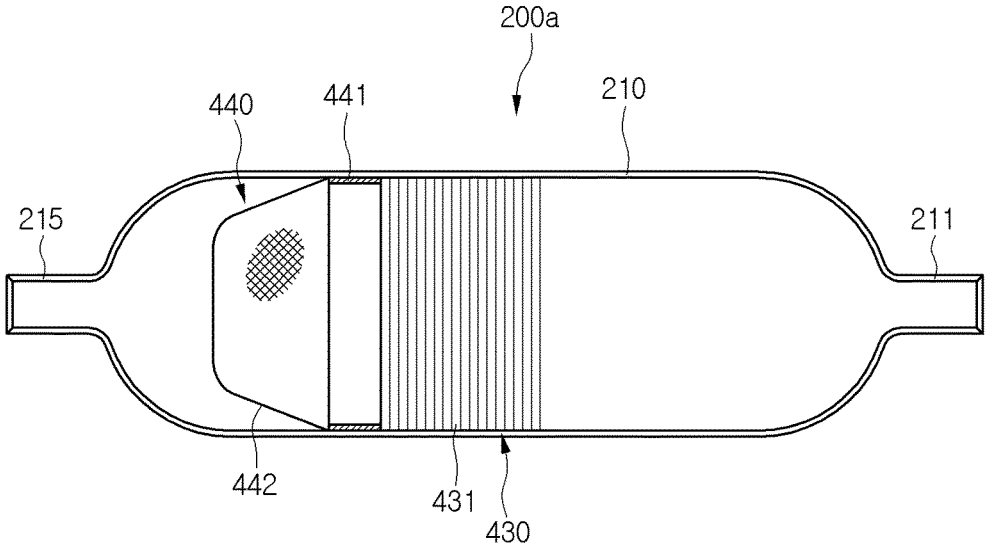
FIG. 15 is a view of a dryer according to another embodiment.
Figure 16:
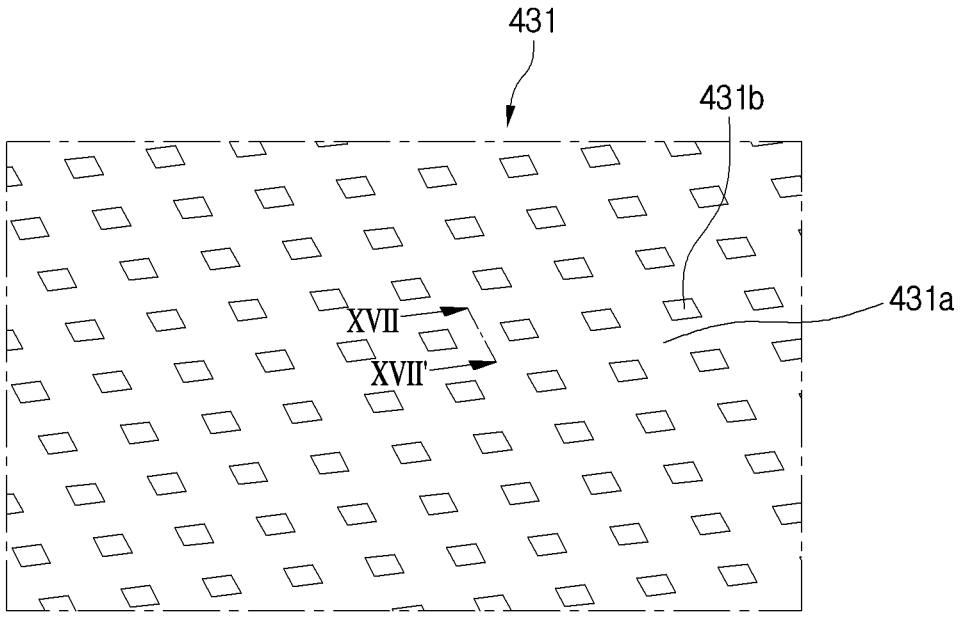
FIG. 16 is a schematic view of an adsorbent provided in the dryer of FIG. 15.
Figure 17:
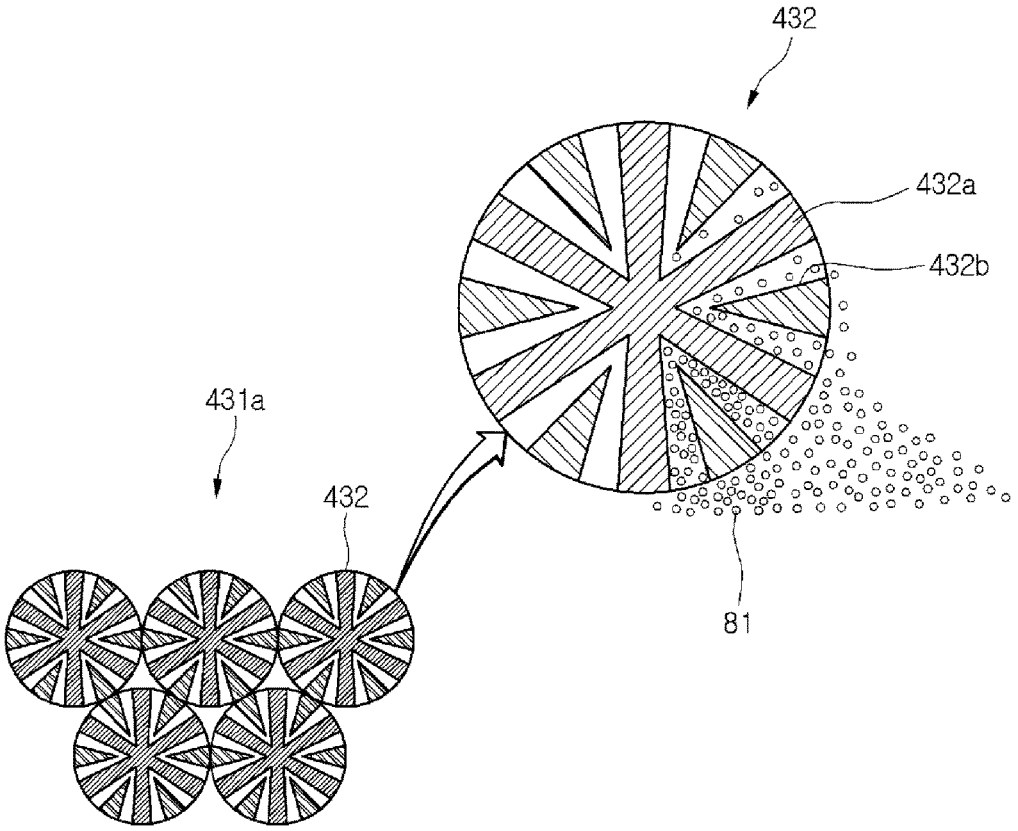
FIG. 17 is a cross-sectional view, taken along line XVII-XVII of FIG. 16.
Figure 18:
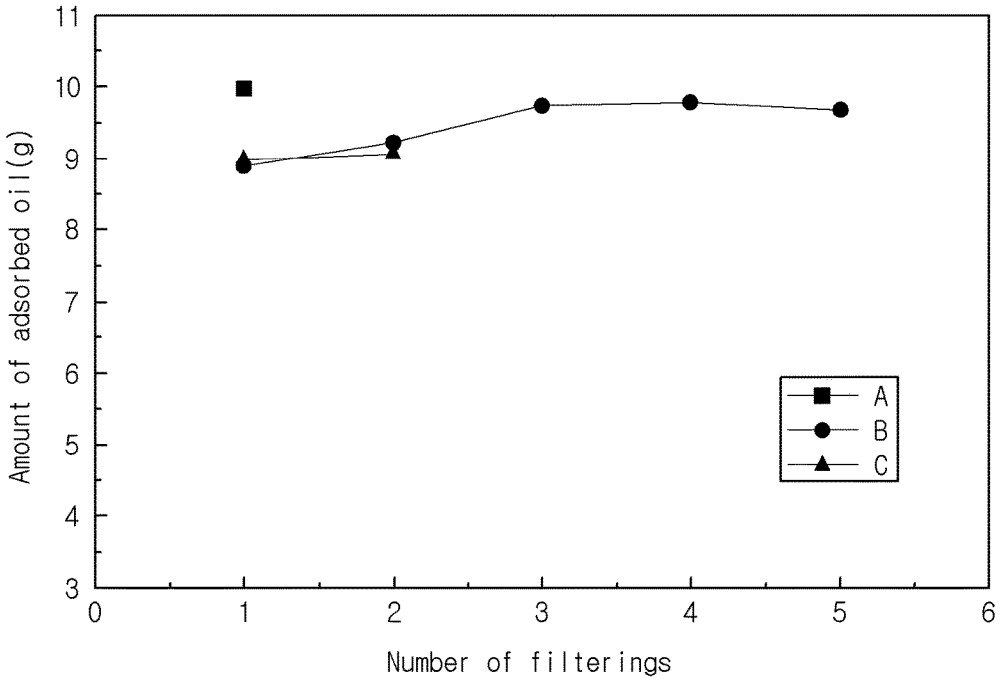
FIG. 18 is a graph illustrating a test result obtained by the oil adsorption test device of FIG. 5.

FIG. 15 is a view of a dryer according to another embodiment. FIG. 16 is a schematic view of an adsorbent provided in the dryer of FIG. 15. FIG. 17 is a cross-sectional view, taken along line XVII-XVII' of FIG. 16. FIG. 18 is a graph illustrating a test result obtained by the oil adsorption test device of FIG. 15.

Referring to FIGS. 15 to 17, dryer 200*a* according to this embodiment may include dryer body 210 that defines a flow space of a refrigerant, refrigerant inflow 211 disposed on one or the first side of the dryer body 210 to guide introduction of the refrigerant, and refrigerant discharge 215 disposed on the other or the second side of the dryer body 210 to guide discharge of the refrigerant.

Dryer filters 430 and 440 may be provided in the dryer body 210. In detail, the dryer filters 430 and 440 may include a mesh filter 440 fixed to the inside of the dryer body 210, and an adsorption filter 430 disposed on or at one side of the mesh filter 440. The mesh filter 440 may include a coupling portion 441 coupled to an inner circumferential surface of the dryer body 210, and a mesh 442 that extends from the coupling portion 441 in a direction of the refrigerant discharge 215.

A foreign substance having a fine size contained in the refrigerant may be filtered by the mesh 242. Thus, it may prevent the expansion device 30 from being blocked by the refrigerant flowing into the expansion device 30 after passing through the dryer 200.

The mesh filter 440 may serve as a support to support the adsorption filter 430 so that the adsorption filter 430 may be disposed within the dryer body 210. The adsorption filter 430 may include at least one adsorbent 431. The adsorbent 431 may be provided as an oil adsorption fabric or felt to adsorb oil. The adsorbent 431 may have a predetermined thickness. For example, the predetermined thickness may be about 0.2 mm.

The adsorbent 431 may have a "fabric" shape and a plurality of the absorbent 431 may be provided. The plurality of adsorbents 431 may be parallely provided to form a multilayer structure. A direction in which the multilayer structure is formed may correspond to a direction from the refrigerant inflow 211 toward the refrigerant discharge 215. Thus, the oil in the refrigerant introduced through the refrigerant inflow 211 may be filtered while passing through the plurality of adsorbents 431 having the multilayer structure.

The adsorbent(s) 431 may be attached to the mesh filter 440, or attached to an inner circumferential surface of the dryer body 210. Further, each adsorbent 431 may include an adsorption body 431*a*, on which or into which the oil may be adsorbed, and a plurality of holes 431*b* defined in the adsorption body 431*a*. An adsorption area of the oil may increase by the plurality of holes 431*b*.

The adsorption body 431*a* may include a plurality of adsorption fibers 432 formed of a polyethylene terephthalate (PET) material. The PET-based fiber may have a superior surface tension when compared to other-based fiber, for example, polypropylene (PP), polyethylene (PE), or polybutylene yerephthalate (PBT)-based fiber.

For example, the PP, PE, or PBT-based fiber may have a surface tension of about 29 mN/m to about 32 mN/m. However, the PET-based fiber may have a surface tension of about 41 mN/m to about 44 mN/m.

Also, the PET-based fiber may have a surface tension greater than a surface tension that (about 20 mN/m) of the oil. In this case, the oil may be well adsorbed into the adsorption fiber 432.

On the other hand, the PET-based fiber may have a surface tension less than a surface tension (about 58 mN/m to about 76 mN/m, 0.degree. C. water: about 75.6 mN/m, and 100.degree. C. water: about 58.90 mN/m) of water. In this case, water may not be adsorbed into the adsorption fiber 432.

The plurality of adsorption fibers 432 may be crumpled or twisted with each other to form a skein. In this case, an adsorption area of the oil may increase, and adhesion of the oil may be improved. In addition, cohesiveness of the oil within the adsorption fiber 432 may increase.

The term "adhesion" may refer to a force by which the oil is attached to a surface of the adsorption fiber 432, and the term "cohesiveness" may refer to a force (for preventing re-scattering) by which the oil is pulled by itself to prevent the oil from being spread on a hard surface.

A pore having a preset or predetermined size or more may be defined between the plurality of adsorption fiber 432 having the skein. For example, the preset or predetermined size may be about 20 μm or more, more particularly, about 25 μm or more. As the pore has the preset or predetermined size or more, it may prevent refrigerant flow loss due to pressure drop from occurring when the refrigerant or molecule passes through the adsorbent 431.

The adsorption fiber 432 may includes a fiber body 432*a*, and a plurality of recesses 432*b* recessed inward from the fiber body 432*a* to guide adsorption of the oil. Each of the recesses 432*b* may have a thin thickness or width.

Oil particles 81 may flow into the recesses 432*b* of the adsorption fiber 432 by a capillary action. As described above, the surface tension of the PET-based adsorption fiber may be greater than the surface tension of the oil. In this case, the capillary action may be easily performed. Due to the capillary action, oil adsorption onto the adsorption fiber 432 may be improved.

FIG. 18 is a view illustrating a state in which an amount of adsorbed oil increases depending on a number of filterings according to the above-described measuring method. Referring to FIG. 18, three oils A, B, and C were used in the test. The oils included working oil (drawing oil and cutting oil) used when the plurality of devices provided in the cooling system are installed. Also, about 10 g of each of the oils was injected, and about 1.6 g of the adsorbent 431 was used as an oil adsorption fabric.

For all of the oils A, B, and C, it is seen that the greater the number of filterings, the greater an amount of oil adsorbed onto or into the adsorbent 431. Further, in the case of oil A, when the filtering is performed once, almost all of the oil may be filtered. In the case of oil B, when the filtering is performed two times, almost all of the oil may be filtered. In the case of oil C, when the filtering is performed three times, almost all of the oil may be filtered. However, when the filtering is performed four or five times, an amount of adsorbed oil may be changeless or slightly reduced. This is because a portion of the oil adsorbed onto the adsorbent 431 is discharged from the adsorbent tank 330 when the test is repeatedly performed.

As described above, it is seen that a filtering effect of the oil contained in the refrigerant is superior when the adsorbent 431 is applied to the dryer 200*a*. In particular, when the refrigeration cycle operates in the cooling system, the refrigerant may be continuously circulated and filtered several times in the dryer 200*a*. Thus, almost all of the oil contained in the refrigerant may be filtered.

Figure 19:
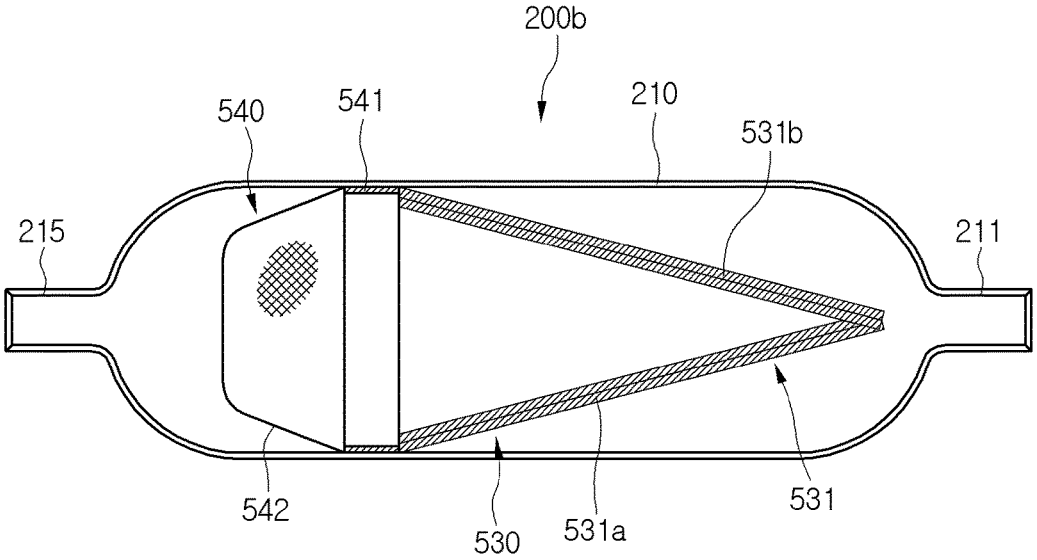
FIG. 19 is a view of an adsorbent provided in a dryer according to another embodiment.

FIG. 19 is a view of an adsorbent provided in a dryer according to another embodiment. Referring to FIG. 19, dryer 200*b* according to this embodiment may include dryer body 210 that defines a flow space of a refrigerant, refrigerant inflow 211 disposed on or at one or the first side of the dryer body 210 to guide introduction of the refrigerant, and a refrigerant discharge 215 disposed on or at the other or the second side of the dryer body 210 to guide discharge of the refrigerant.

Dryer filters 530 and 540 may be provided in the dryer body 210. The dryer filters 530 and 540 may include a mesh filter 540 fixed to the inside of the dryer body 210, and an adsorption filter 530 disposed on or at one side of the mesh filter 540. The mesh filter 540 may include a coupling portion 541 coupled to an inner circumferential surface of the dryer body 210, and a mesh 542 that extends from the coupling 541 in a direction of the refrigerant discharge 215.

The adsorption filter 530 may includes one or more adsorbents 531. Each of the one or more adsorbent 531 may be provided as an oil adsorption fabric or felt to adsorb oil. The one or more adsorbents 531 may each have a "fabric" shape.

A plurality of the adsorbents 531 may be provided. In detail, the plurality of adsorbents 531 may include a first adsorbent 531*a* coupled to a first side of the mesh filter 540 and that extends at an incline toward the refrigerant inflow 211 in a direction that crosses the flow direction of the refrigerant. A second adsorbent 531*b* may be coupled to a second side of the mesh filter 540 and that extends at an incline toward the refrigerant inflow 211 in the direction that crosses the flow direction of the refrigerant.

The first and second adsorbents 531*a* and 531*b* may extend in directions crossing each other. For example, one side of the first adsorbent 531*a* and one side of the second adsorbent 531*b* may be coupled to each other. Thus, flow pressure loss of the refrigerant and oil may be reduced.

The oil of the refrigerant introduced through the refrigerant inflow 211 may be filtered by the plurality of adsorbents 531 and 531*b* disposed to cross each other. Then, after the filtering of the oil, the refrigerant may flow into the refrigerant discharge 215. As the adsorbents 531*a* and 531*b* may be the same as the adsorbent according to the previous embodiment, detail descriptions thereof have been omitted.

Figure 20:
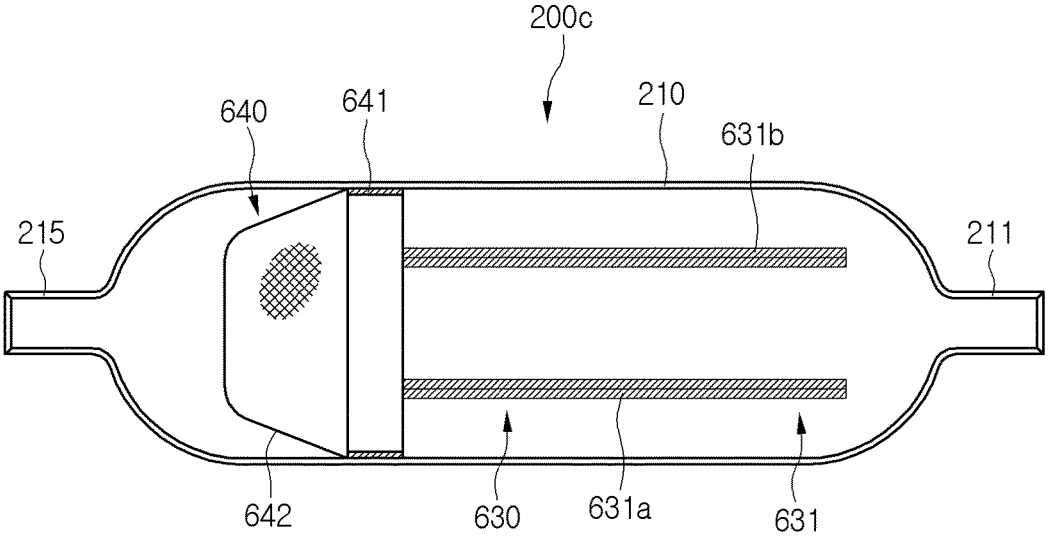
FIG. 20 is a view of an adsorbent provided in a dryer according to another embodiment.

FIG. 20 is a view of an adsorbent provided in a dryer according to another embodiment. Referring to FIG. 20, dryer 200*c* according to this embodiment may include dryer body 210 that defines a flow space of a refrigerant, refrigerant inflow 211 disposed on or at one or the first side of the dryer body 210 to guide introduction of the refrigerant, and a refrigerant discharge 215 disposed on or at the other or the second side of the dryer body 210 to guide discharge of the refrigerant.

Dryer filters 630 and 640 may be provided in the dryer body 210. In detail, the dryer filters 630 and 640 may include a mesh filter 640 fixed to the inside of the dryer body 210, and an adsorption filter 630 disposed on or at one side of the mesh filter 640. The mesh filter 640 may include a coupling portion 641 coupled to an inner circumferential surface of the dryer body 210, and a mesh 641 that extends from the coupling portion 641 in a direction of the refrigerant discharge 215.

The adsorption filter 630 may include one or more adsorbents 631. Each of the one or more adsorbents 631 may be provided as an oil adsorption fabric or felt to adsorb oil.

The one or more adsorbent 631 may each have a "fabric" shape. A plurality of adsorbents 631 may be provided. In detail, the plurality of adsorbents 631 may include a first adsorbent 631*a* coupled to a first side of the mesh filter 640 and that extends toward the refrigerant inflow 211 in a direction corresponding to the flow direction of the refrigerant. A second adsorbent 631*b* may be coupled to a second side of the mesh filter 640 and that extends toward the refrigerant inflow 211 in the direction corresponding to the flow direction of the refrigerant.

The first and second adsorbents 631*a* and 631*b* may be spaced apart from each other. Thus, flow spaces for the refrigerant and oil may be respectively defined between an inner circumferential surface of the dryer body 210 and the first adsorbent 631*a*, between the first adsorbent 631*a* and the second adsorbent 631*b*, and between the second adsorbent 631*b* and the inner circumferential surface of the dryer body 210. Thus, flow pressure loss of the refrigerant and oil may be reduced.

The oil in the refrigerant introduced through the refrigerant inflow 211 may be filtered by the plurality of adsorbents 631*a* and 631*b*. Then, after the filtering of the oil, the refrigerant may flow into the refrigerant discharge 215. As the adsorbents 631*a* and 631*b* may be the same as the adsorbent according to the previous embodiment, detail descriptions thereof have been omitted.

According to embodiments disclosed herein, the compressor including inner components may decrease in size to reduce a volume of a machine room of a refrigerator and increase an inner storage space of the refrigerant. Also, a drive frequency of the compressor may increase to prevent the performance of the inner components from being deteriorated due to the decreasing size thereof. In addition, as the gas bearing is applied between the cylinder and the piston, friction force occurring due to oil may be reduced.

Also, the filter device may be provided in the dryer provided in the cooling system or the refrigerator to filter moisture, foreign substances, or oil contained in the refrigerator. More particularly, the adsorbent having the molecular sieve shape or the fiber adsorbent having the felt shape may be provided in the dryer to improve adsorption of oil.

Also, as the plurality of filtering device may be provided in the compressor, it may prevent the foreign substances or oil contained in the compression gas (or discharge gas) introduced to the outside of the piston from the nozzle of the cylinder from being introduced. More particularly, the first filter may be provided on the suction muffler to prevent the foreign substances contained in the refrigerant from being introduced into the compression chamber. The second filter may be provided on the coupling portion between the cylinder and the frame to prevent the foreign substances and oil contained in the compressed refrigerant gas from flowing into the gas inflow of the cylinder. The third filter may be provided on the gas inflow of the cylinder to prevent the foreign substances and oil from being introduced into the nozzle of the cylinder from the gas inflow.

As described above, as foreign substances or oil contained in the compression gas that acts as the gas bearing in the compressor may be filtered through or by the plurality of filtering devices provided in the compressor and dryer, it may prevent the nozzle of the cylinder from being blocked by the foreign substances or oil. As blocking of the nozzle of the cylinder is prevented, the gas bearing effect may be effectively performed between the cylinder and the piston, and thus, abrasion of the cylinder and the piston may be prevented.

Embodiments disclosed herein provide a cooling system in which a gas bearing may easily operate between a cylinder and a piston of a linear compressor and a refrigerant including a cooling system.

Embodiments disclosed herein provide a cooling system that may include a linear compressor including a reciprocating piston and a cylinder that accommodates the piston and having an outer circumferential surface to introduce a refrigerant therethrough; a refrigerant filter device provided in the linear compressor to filter the refrigerant introduced into a gas inflow part or inflow of the cylinder; a condenser that condenses the refrigerant compressed in the linear compressor; and a dryer that removes foreign substances or oil of or in the refrigerant condensed in the condenser. The dryer may include a dryer body including a refrigerant inflow part or inflow to introduce the refrigerant condensed in the condenser, and a refrigerant discharge part or discharge to discharge the refrigerant; and an adsorption filter accommodated in the dryer body to filter the oil of the refrigerant introduced into the refrigerant inflow part.

The adsorption filter may include a plurality of adsorbents, which may be provided as a molecular sieve having a grain shape. Each of the adsorbents may have a size or diameter of about 5 mm to about 10 mm.

Each of the adsorbents may include an adsorption body having an adsorption surface and a plurality of adsorption grooves defined in the adsorption body. The adsorption body may include an inlet part or inlet recessed from the adsorption surface toward an inside of the adsorption body to guide introduction of oil particles contained in the refrigerant, and an oil adsorption part or portion further recessed from the inlet part to store the oil particles. The inlet part may have a size or diameter equal to or greater than that of each of the oil particles. The inlet part may have a size or diameter of about 9 Å to about 11 Å.

The dryer may further include a first dryer filter disposed inside the refrigerant inflow part, and a third dryer filter disposed inside the refrigerant discharge part. The adsorption filter may be disposed between the first dryer filter and the third dryer filter.

An outer circumferential surface of the first dryer filter may be coupled to an inner circumferential surface of the dryer body and have a plurality of through holes to guide a flow of the refrigerant. The third dryer filter may include a coupling part or portion coupled to an inner circumferential surface of the dryer body and a mesh part or mesh that extends from the coupling part toward the refrigerant discharge part.

The adsorption filter may include adsorbents, which may be provided as an oil adsorption fabric or felt formed of a polyethylene terephthalate (PET) material. The adsorbents may be arranged in parallel to each other to form a multilayer structure. A direction for forming the multilayer structure of the adsorbents may correspond to a direction from the refrigerant inflow part toward the refrigerant discharge part.

Each of the adsorbents may include an adsorption body to adsorb the oil, and a plurality of holes defined in the adsorption body. The adsorption body may include a plurality of adsorption fibers formed of the polyethylene terephthalate (PET) material. The plurality of adsorption fibers may be crumpled or twisted with each other to form a skein. A pore defined between the plurality of adsorption fibers may have a size of about 20 μm or more.

Each of the adsorption fibers may include a fiber body, and a plurality of recess parts or recesses recessed inward from the fiber body to guide adsorption of the oil.

A mesh filter that supports the adsorbents and including a mesh part or mesh to filter the foreign substances may be disposed within the dryer body. The adsorbents may include a adsorbents coupled to one or a first side of the mesh filter to inclinedly extend in a direction crossing a flow direction of the refrigerant, and a second adsorbent coupled to the other or a second side of the mesh filter to inclinedly extend in the direction crossing the flow direction of the refrigerant. The first and second adsorbents may extend in the directions crossing each other and be coupled to each other. The first and second adsorbents may be spaced apart from each other to define a flow space for the refrigerant or oil.

According to another embodiment disclosed herein, a refrigerator including the cooling system may be provided.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooling system, comprising:

a linear compressor comprising a reciprocating piston and a cylinder that accommodates the piston and having an outer circumferential surface through which a refrigerant is introduced;

a refrigerant filter provided in the linear compressor to filter the refrigerant introduced through the outer circumferential surface of the cylinder;

a condenser that condenses the refrigerant compressed in the linear compressor; and a dryer to remove foreign substances or oil from the refrigerant condensed in the condenser, wherein the dryer comprises:

a dryer body comprising a refrigerant inflow, through which the refrigerant condensed in the condenser is introduced into the dryer, and a refrigerant discharge, through which the refrigerant is discharged from the dryer, and a first dryer filter in the form of an adsorption filter accommodated in the dryer body to filter the oil from the refrigerant introduced through the refrigerant inflow, wherein the adsorption filter comprises a plurality of adsorbents, wherein each of the plurality of adsorbents comprises a molecular sieve having a grain shape, and wherein the molecular sieve has a diameter of about 5 mm to about 10 mm, and wherein the molecular sieve comprises an adsorption body having an adsorption surface and a plurality of adsorption grooves defined in the adsorption body.

2. The cooling system according to claim 1, wherein each of the plurality of adsorption grooves comprises:

an inlet recessed from the adsorption surface toward an inside of the adsorption body to guide introduction of oil particles contained in the refrigerant into the adsorption body; and an oil adsorption portion further recessed from the inlet to store the oil particles.

3. The cooling system according to claim 2, wherein a diameter of the inlet is equal to or greater than a diameter of each of the oil particles.

4. The cooling system according to claim 3, wherein the inlet has a size or diameter of about 9 Å to about 11 Å.

5. The cooling system according to claim 1, wherein the dryer comprises:

a second dryer filter disposed adjacent to an inside of the refrigerant inflow; and a third dryer filter disposed adjacent to an inside of the refrigerant discharge.

6. The cooling system according to claim 5, wherein the adsorption filter is installed between the second dryer filter and the third dryer filter.

7. The cooling system according to claim 5, wherein an outer circumferential surface of the second dryer filter is coupled to an inner circumferential surface of the dryer body and has a plurality of through holes to guide a flow of the refrigerant.

8. The cooling system according to claim 5, wherein the third dryer filter comprises:

a coupling portion coupled to an inner circumferential surface of the dryer body; and a mesh that extends from the coupling portion toward the refrigerant discharge.

9. A refrigerator including the cooling system according to claim 1.

10. The cooling system according to claim 1, wherein the dryer body has a cylindrical shape.

11. The cooling system according to claim 5, wherein the second filter has an approximately hemispherical shape.

12. The cooling system according to claim 1, further comprising an expansion device that decompresses the refrigerant received from the dryer; and an evaporator that evaporates the refrigerant decompressed in the expansion device.

13. The cooling system according to claim 12, further comprising:

a condensation fan that blows air toward the condenser; and an evaporation fan that blows air toward the evaporator.

14. The cooling system according to claim 1, wherein the linear compressor further comprises:

a cylindrical shell, a first cover coupled to a first side of the shell, and a second cover coupled to a second side of the shell;

a frame fixedly installed in the shell;

a motor that drives the piston;

a suction inlet through which the refrigerant is introduced into the cylinder; and a discharge outlet through which the refrigerant compressed in the cylinder is discharged out of the shell.

15. The cooling system according to claim 14, wherein the cylinder is coupled to the frame.

16. A cooling system, comprising:

a linear compressor comprising a reciprocating piston and a cylinder that accommodates the piston and having an outer circumferential surface through which a refrigerant is introduced;

a refrigerant filter provided in the linear compressor to filter the refrigerant introduced through the outer circumferential surface of the cylinder;

a condenser that condenses the refrigerant compressed in the linear compressor, and a dryer to remove foreign substances or oil from the refrigerant condensed in the condenser, wherein the dryer comprises:

a dryer body comprising a refrigerant inflow, through which the refrigerant condensed in the condenser is introduced into the dryer, and a refrigerant discharge, through which the refrigerant is discharged from the dryer; and a plurality of filters accommodated in the dryer body to filter the foreign substance or oil from the refrigerant introduced through the refrigerant inflow, wherein the plurality of filters comprises:

a mesh filter; and an adsorption filter supported by the mesh filter, wherein the adsorption filter comprises a plurality of adsorbents, wherein each of the plurality of adsorbents comprises an adsorption body having an adsorption surface and a plurality of adsorption grooves defined in the adsorption body, and wherein each of the plurality of adsorption grooves comprises:

an inlet recessed from the adsorption surface toward an inside of the adsorption body to guide introduction of oil particles contained in the refrigerant into the adsorption body; and an oil adsorption portion further recessed from the inlet to store the oil particles.

17. A refrigerator including the cooling system according to claim 16.

* * * * *